US009581303B2

(12) United States Patent
Gordin et al.

(10) Patent No.: US 9,581,303 B2
(45) Date of Patent: Feb. 28, 2017

(54) COMPACT AND ADJUSTABLE LED LIGHTING APPARATUS, AND METHOD AND SYSTEM FOR OPERATING SUCH LONG-TERM

(75) Inventors: Myron Gordin, Oskaloosa, IA (US); Timothy J. Boyle, Oskaloosa, IA (US); Thomas A. Stone, University Park, IA (US)

(73) Assignee: Musco Corporation, Oskaloosa, IA (US)

( * ) Notice: Subject to any disclaimer, the term of this patent is extended or adjusted under 35 U.S.C. 154(b) by 1401 days.

(21) Appl. No.: 13/399,291

(22) Filed: Feb. 17, 2012

(65) Prior Publication Data

US 2012/0217897 A1 Aug. 30, 2012

Related U.S. Application Data

(60) Provisional application No. 61/446,915, filed on Feb. 25, 2011.

(51) Int. Cl.
*F21S 8/00* (2006.01)
*F21V 19/02* (2006.01)
(Continued)

(52) U.S. Cl.
CPC ..... *F21S 8/086* (2013.01); *F21V 5/04* (2013.01); *F21V 7/00* (2013.01); *F21V 11/00* (2013.01);
(Continued)

(58) Field of Classification Search
CPC ..... F21S 8/086; F21W 2131/103; F21W 2131/105; F21V 31/005; F21V 29/004;
(Continued)

(56) References Cited

U.S. PATENT DOCUMENTS 3,483,428 A 12/1969 La Plante
4,107,770 A 8/1978 Weber
(Continued)

FOREIGN PATENT DOCUMENTS

AU 2004237249 B2 11/2004
EP 0669788 B1 5/2000
(Continued)

OTHER PUBLICATIONS

Musco Corporation et al., PCT/US2012/025599 filed Feb. 17, 2012, "Notification of Transmittal of the International Search Report and the Written Opinion of the International Searching Authority, or the Declaration" mailed Dec. 3, 2012.
(Continued)

*Primary Examiner* — Karabi Guharay
*Assistant Examiner* — Arman B Fallahkhair
(74) *Attorney, Agent, or Firm* — McKee, Voorhees & Sease, PLC

(57) ABSTRACT

A lighting system is provided whereby long operating life can be reasonably ensured by taking into account requirements of the application, characteristics of the LEDs, characteristics of the fixture containing said LEDs, the desired number of operating hours, and—via developed relationships—taking an iterative approach to supplying power to the LEDs. Through the envisioned compensation methodology and effective luminaire design, a relatively constant light level can be assured for a predetermined number of operating hours (possibly longer); this is true even if operating conditions change, known behavior of LEDs proves untrue over untested period of time, or some other condition occurs which would otherwise cause end-of-life prematurely and prevent the system from meeting the desired number of operating hours.

10 Claims, 36 Drawing Sheets

(51) Int. Cl.

| | |
|---|---|
| ***F21V 7/00*** | (2006.01) |
| ***F21S 8/08*** | (2006.01) |
| ***F21V 31/00*** | (2006.01) |
| ***F21V 5/04*** | (2006.01) |
| ***F21V 11/00*** | (2015.01) |
| ***F21V 21/30*** | (2006.01) |
| ***F21V 23/04*** | (2006.01) |
| *F21V 29/00* | (2015.01) |
| *F21V 17/00* | (2006.01) |
| *F21V 23/00* | (2015.01) |
| *F21W 131/103* | (2006.01) |
| *F21W 131/105* | (2006.01) |
| *F21V 29/76* | (2015.01) |
| *F21Y 101/00* | (2016.01) |

(52) U.S. Cl.
CPC ..... *F21V 21/30* (2013.01); *F21V 23/0435* (2013.01); *F21V 31/005* (2013.01); *F21V 17/002* (2013.01); *F21V 17/005* (2013.01); *F21V 23/008* (2013.01); *F21V 23/0442* (2013.01); *F21V 29/004* (2013.01); *F21V 29/763* (2015.01); *F21W 2131/103* (2013.01); *F21W 2131/105* (2013.01); *F21Y 2101/00* (2013.01); *Y10T 29/49826* (2015.01)

(58) Field of Classification Search
CPC .... F21V 29/763; F21V 17/002; F21V 17/005; F21V 23/008; F21V 23/0435; F21V 23/0442; F21V 21/30; F21V 11/00; F21V 7/00; F21V 5/04; Y10T 29/49826
USPC ..... 362/431, 287, 346, 249.03, 249.07, 427, 362/429, 294, 249.09, 418, 247
See application file for complete search history.

(56) References Cited

U.S. PATENT DOCUMENTS 4,135,116 A 1/1979 Smith
4,319,311 A * 3/1982 Mitchell ..... F21V 23/00 362/249.09
4,450,507 A 5/1984 Gordin
4,475,065 A 10/1984 Bhalla et al.
4,701,669 A 10/1987 Head et al.
5,092,552 A 3/1992 Dayton et al.
5,207,747 A * 5/1993 Gordin ..... F21V 21/30 362/233
5,253,336 A 10/1993 Yamada
5,259,091 A 11/1993 Mordick
5,313,379 A * 5/1994 Lemons ..... F21V 7/09 362/298
5,584,574 A 12/1996 Haddad
5,783,909 A 7/1998 Hochstein
6,078,148 A 6/2000 Hochstein
6,082,878 A 7/2000 Doubek et al.
6,236,331 B1 5/2001 Dussureault
6,250,774 B1 * 6/2001 Begemann ..... F21V 5/008 362/231
6,292,497 B1 9/2001 Nakano
6,456,016 B1 9/2002 Sundahl et al.
6,543,911 B1 4/2003 Rizkin et al.
6,580,182 B2 6/2003 Janning
6,648,495 B1 11/2003 Hsu
6,733,159 B1 5/2004 Wu
6,734,957 B2 5/2004 Schmidt et al.
6,836,082 B2 * 12/2004 Buij ..... H05B 41/2855 315/224
6,923,551 B2 8/2005 Galli
6,942,363 B1 9/2005 LeVasseur
7,012,604 B1 3/2006 Christie et al.
7,176,635 B2 2/2007 Gordin et al.
7,319,298 B2 1/2008 Jungwirth et al.
7,325,938 B2 2/2008 Yoshida et al.
7,327,097 B2 2/2008 Chang et al.
7,385,360 B2 6/2008 Dluzniak
7,425,798 B2 9/2008 St.-Germain
7,458,700 B2 * 12/2008 Gordin ..... F21S 2/00 362/235
7,495,817 B2 2/2009 Hunt
7,504,783 B2 3/2009 Zarr
7,518,321 B2 4/2009 Chang et al.
7,521,872 B2 4/2009 Bruning
7,540,629 B2 6/2009 Steinberg
7,543,941 B2 6/2009 Holder et al.
7,618,163 B2 11/2009 Wilcox
7,618,171 B2 11/2009 Tessnow et al.
7,625,102 B2 12/2009 Koike et al.
7,654,686 B2 2/2010 Oza
7,654,705 B2 2/2010 Czech et al.
7,675,251 B2 3/2010 Gordin et al.
7,731,402 B2 6/2010 Tessnow et al.
7,734,356 B2 6/2010 Cleland et al.
7,736,014 B2 6/2010 Blomberg
7,766,509 B1 8/2010 Laporte
7,778,635 B2 8/2010 Crookham et al.
7,845,824 B2 12/2010 Robotham
7,857,497 B2 12/2010 Koike et al.
7,863,829 B2 1/2011 Sayers et al.
7,874,055 B2 1/2011 Stone
7,918,591 B2 4/2011 Lynch
7,952,262 B2 5/2011 Wilcox et al.
7,972,035 B2 * 7/2011 Boyer ..... F16B 5/0258 362/244
8,002,425 B2 8/2011 Russo et al.
8,002,435 B2 8/2011 Laporte
8,018,457 B2 9/2011 Peterson et al.
8,021,013 B2 9/2011 Russo et al.
8,066,406 B2 11/2011 Boyer et al.
8,101,434 B2 1/2012 Guillien et al.
8,256,916 B2 * 9/2012 Richmond ..... F21S 9/03 362/183
8,256,921 B2 * 9/2012 Crookham ..... F21S 8/033 362/242
8,342,709 B2 * 1/2013 Lueken ..... F21S 8/086 362/240
8,342,714 B1 * 1/2013 Rea ..... F21V 11/183 362/264
8,390,211 B2 * 3/2013 Green ..... H05B 41/392 315/291
8,622,569 B1 * 1/2014 Crookham ..... F21V 14/02 362/145
8,789,967 B2 * 7/2014 Gordin ..... F21S 4/00 362/223
2002/0198978 A1 12/2002 Watkins
2005/0068765 A1 * 3/2005 Ertze Encinas ..... F21S 9/037 362/183
2006/0176708 A1 8/2006 Gordin et al.
2008/0062689 A1 3/2008 Villard
2008/0296589 A1 12/2008 Speier et al.
2009/0066258 A1 3/2009 Cleland et al.
2009/0206775 A1 8/2009 Green et al.
2010/0020551 A1 1/2010 Kay et al.
2010/0045191 A1 2/2010 Aendekerk
2010/0096993 A1 * 4/2010 Ashdown ..... F21V 29/004 315/113
2010/0157570 A1 6/2010 Xiao et al.
2010/0165643 A1 7/2010 Russo et al.
2010/0328931 A1 12/2010 Fogerlie
2011/0057570 A1 3/2011 Cleland et al.
2011/0074313 A1 3/2011 Gordin
2011/0149582 A1 6/2011 McKee

FOREIGN PATENT DOCUMENTS

JP 09180886 A 7/1997
WO 2005059436 A1 6/2005
WO WO 2008037118 A1 4/2008

OTHER PUBLICATIONS

(56) References Cited

OTHER PUBLICATIONS

Benthin, Carsten, et al., "Interactive Headlight Simulation—A Case Study of Interactive Distributed Ray Tracing", Computer Graphics Group, Saarland University, Technical Report TR-2002-03, Copyright 2002 (6 pages).
Cree, Application Note—"Pulsed Over-Current Driving of XLamp LEDs: Information and Cautions", CLD-AP60 Rev 0, Copyright 2010-2011 (10 pages).
Derwent, Brochure—"AEGIS Intelligent-IR", Copyright 2007-2008, Derwent Systems Ltd. (20 pages).
Illuminating Engineering Society, IES LM-79-08, "Electrical and Photometric Measurements of Solid-State Lighting Products", Copy right 2008 (22 pages).
Illuminating Engineering Society, IES LM-80-08, "Measuring Lumen Maintenance of LED Light Sources", Copyright 2008 (10 pages).
Lumec, A Lumec White Paper—"LEDs for Outdoor Lighting Applications" (date unknown) (11 pages).
Philips-Lumec, Brochure—"LEONIS—Landmark of a New Word" (date unknown) (24 pages).
Philips-Lumec, Brochure—"LifeLED / Breathing Life", Copyright 2008 (20 pages).
Poor, Robert, "Wireless Mesh Networks", http://www.sensorsmag.com/sensors/content/printContentPopup.jsp?id=334971, accessed Jan. 2008 (7 pages).
Sample pages from Philips Lighting Company, "Lighting Handbook: Chapter 13—Roadway and Tunnel Lighting", pp. 13-1-13-16, Copyright 1984 (16 pages).
Stich, Andreas, et al., Application Note—"Osram Ostar Headlamp—Details on Handling, Mounting and Electrical Connection", Mar. 2010 (10 pages).
U.S. Appl. No. 12/534,335, Myron Gordin, et al., filed Aug. 3, 2009 (not published) (95 pages).
U.S. Appl. No. 12/604,572, Myron Gordin, et al., filed Oct. 23, 2009 (not published) (40 pages).

* cited by examiner

SECTION A—A

BACK VIEW

RIGHT VIEW

FRONT VIEW

SECTION B—B

SECTION A—A

FRONT VIEW

BACK VIEW

LEFT SIDE VIEW

BACK VIEW

VIEW D–D

FRONT VIEW

LEFT SIDE VIEW

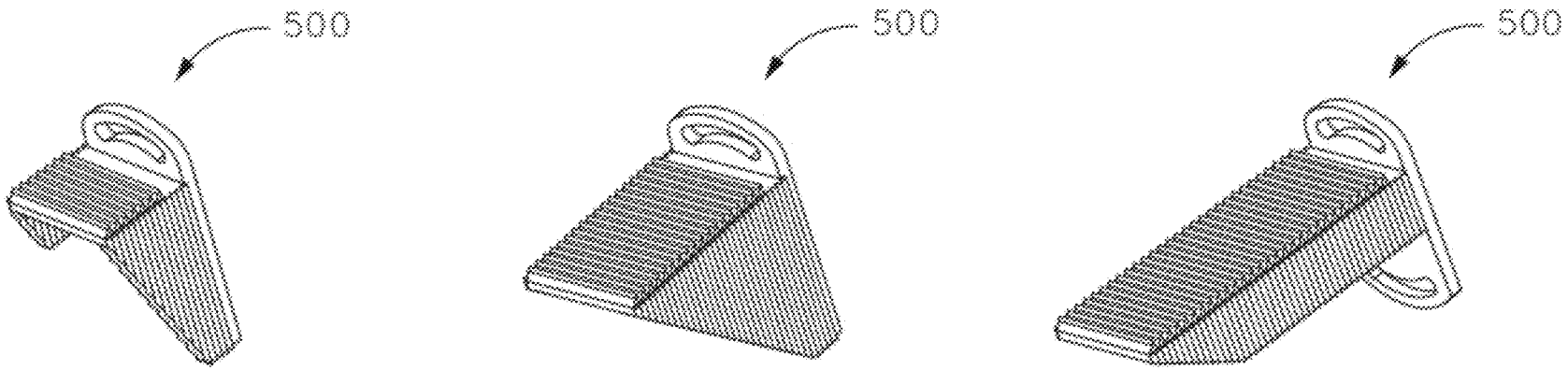
Fig. 5E
Fig. 5F
Fig. 5G
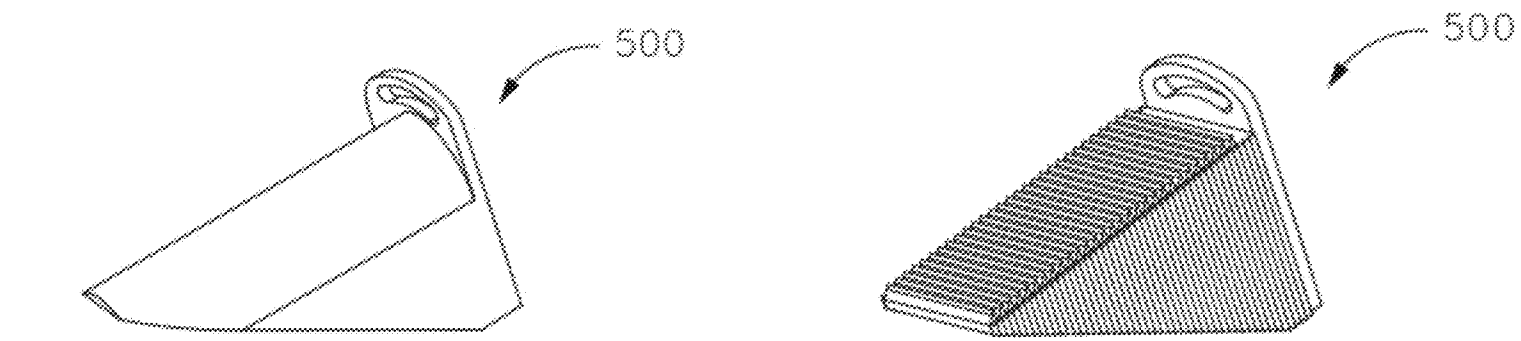
Fig. 5H
Fig. 5I

TOP RIGHT VIEW

TOP VIEW

EXPLODED VIEW

ASSEMBLED VIEW

TOP VIEW

BOTTOM VIEW

PERSPECTIVE VIEW

FRONT VIEW

BACK VIEW

RIGHT VIEW

LEFT VIEW

SIDE VIEW

BACK VIEW

FRONT VIEW

SECTION A–A

DETAIL A–A

SECTION B–B

VIEW A–A

COMPACT AND ADJUSTABLE LED LIGHTING APPARATUS, AND METHOD AND SYSTEM FOR OPERATING SUCH LONG-TERM

CROSS-REFERENCE TO RELATED APPLICATIONS

This application claims priority under 35 U.S.C. §119 to provisional U.S. Application Ser. No. 61/446,915, filed Feb. 25, 2011 which is hereby incorporated by reference in its entirety.

I. BACKGROUND OF THE INVENTION

The present invention generally relates to light-emitting diodes (LEDs), and more particularly, to the design of a lighting apparatus and lighting system using such in a manner that maximizes the benefits of LEDs to satisfy difficult lighting requirements.

By now it is well known that the use of LEDs in general lighting applications yields substantial benefits: long operating life, high efficacy, and precise control of light are at the forefront. However, it is also well known that to get the most out of LEDs a number of factors must be considered: temperature (both ambient and junction) and luminaire design, for example. LEDs are quickly becoming the light source of choice for architectural or aesthetic lighting applications (e.g., façade lighting, holiday lighting, indoor track lighting, etc.), but their usefulness in long-term, large-scale lighting applications has been more slowly realized. This is due, at least in part, to the tremendous efforts needed to control such things as ambient and junction temperature, as well as the efficiency of the luminaire design. In essence, because the benefits of operating LEDs are so closely coupled to the particulars of the lighting application, there is no such thing as a standard large-scale LED lighting fixture. Couple this with only a rudimentary understanding the industry has of how long LEDs can be operated effectively, and it can be seen that there is significant room for improvement in the art.

Consider an outdoor bridge spanning some length and accommodating some number of lanes of traffic in both directions; assume this bridge is used heavily both day and night. For the safety of nighttime drivers, the road on the bridge must be illuminated; here lies an application that exemplifies the challenges faced by today's lighting designers. Cost effectiveness suggests lighting fixtures should be affixed to existing structural features (e.g., to avoid the cost of support structures and the cost to shut down multiple lanes of traffic to erect said structures); however, mounting height and aiming of said fixtures must be considered so not to cause glare or create other adverse driving conditions (the difficulty of which is exacerbated because traffic flows in both directions). The lighting designer must take into account placement of the fixtures, weight of the fixtures, and outward design of the fixtures to ensure both adequate distribution of light on and about the target area, and distribution of stresses on the poles (e.g., because of wind loading). At all times, there are competing design considerations. For example, LEDs offer the benefit of long life (a boon to cost effectiveness), but must be used in great quantity to produce the light needed (a detriment to cost effectiveness). A plurality of light sources means the composite light projected therefrom can be precisely controlled to suit the target area, but it also means additional optical elements for each light source (adding to the cost and weight of each fixture).

Additionally, there is a vested interest in designing the lighting system at the onset for long-term use; in the aforementioned example, it is simply not economically feasible to shut down multiple lanes of traffic over the life of the system to perform maintenance, re-lamp, etc. Thus, LEDs are a natural choice; their long life removes some concerns with long-term maintenance. However, because LEDs have such a long life they have not been fully tested; thus, there are no definitive answers as to how long LEDs can operate and how severely the light output will degrade over time due to thermal losses and lumen depreciation (not to mention initial efficiency losses due to driver inefficiencies and luminaire design). The Illuminating Engineering Society of North America (IESNA) has recently recommended standards for testing LEDs (see IES LM-79) and measuring lumen depreciation (see IES LM-80), but the scope is limited and does not define or provide estimations for the lifespan of LEDs.

The art is at a loss; in the time it would take to fully test an LED, the technology will have advanced and the data will not be particularly useful. In the meantime, there are lighting applications that may benefit from the long life of LEDs provided that long life can be assured. What is needed are means for reasonably assuring the long life of LEDs in a manner that is reliable and, unlike current maintenance strategies, cost-effective for applications like the aforementioned bridge. Further, what is needed are means for reasonably assuring an acceptable light level over said life; there is little benefit to maintaining an LED lighting system long-term if the light is allowed to degrade to the point of uselessness. Still further, what is needed is a standardized approach to developing large-scale LED fixtures—particularly ones for outdoor use—that can be used with said means for assuring the long life of LEDs so to address current needs. Thus, there is room for improvement in the art.

II. SUMMARY OF THE INVENTION

Light-emitting diodes (LEDs) are an attractive alternative to traditional light sources (e.g., metal halide, incandescent, fluorescent, high pressure sodium) for many applications for a variety of reasons, particularly applications where long life is desirable. That being said, many large-scale outdoor lighting applications are based on a budget and the budget assumes a certain number of operating hours before maintenance is performed or before the system has reached its end-of-life (EOL). This is problematic because the longevity of LEDs is highly dependent on operating conditions—many of which cannot be closely controlled—thus limiting the ability to predict or assure a certain number of operating hours. Further, LEDs are not fully characterized so their behavior long-term is not well understood.

It is therefore a principle object, feature, advantage, or aspect of the present invention to improve over the state of the art and/or address problems, issues, or deficiencies in the art.

According to the present invention, a lighting system is provided whereby a number of operating hours can be reasonably ensured for a particular combination of LED and fixture. Through the envisioned power compensation methodology and effective luminaire design, a relatively constant light level can be assured for the defined lifespan of the system; this is true even if operating conditions change, the known behavior of LEDs proves untrue over untested periods of time, or some other condition occurs which would otherwise cause EOL prematurely and prevent the system from meeting the desired number of operating hours.

Further objects, features, advantages, or aspects of the present invention may include one or more of the following:

a. customizable LED modules for placement in customizable LED fixtures such that said fixtures are suitable for a variety of large-scale applications;
b. methods of aiming said modules and said fixtures so to produce a customized composite beam pattern on, at, or about a target area;
c. means for ensuring a relatively constant light output over a predefined length of time;
d. means for providing uplighting in addition to or as part of said customized composite beam pattern;
e. a robust luminaire design suitable for outdoor use; and
f. means to correct for undesirable operating conditions so to aid in ensuring the longevity of LEDs in said LED fixtures.

These and other objects, features, advantages, or aspects of the present invention will become more apparent with reference to the accompanying specification and claims.

III. BRIEF DESCRIPTION OF THE DRAWINGS

From time-to-time in this description reference will be taken to the drawings which are identified by figure number and are summarized below.

Figure 1A:
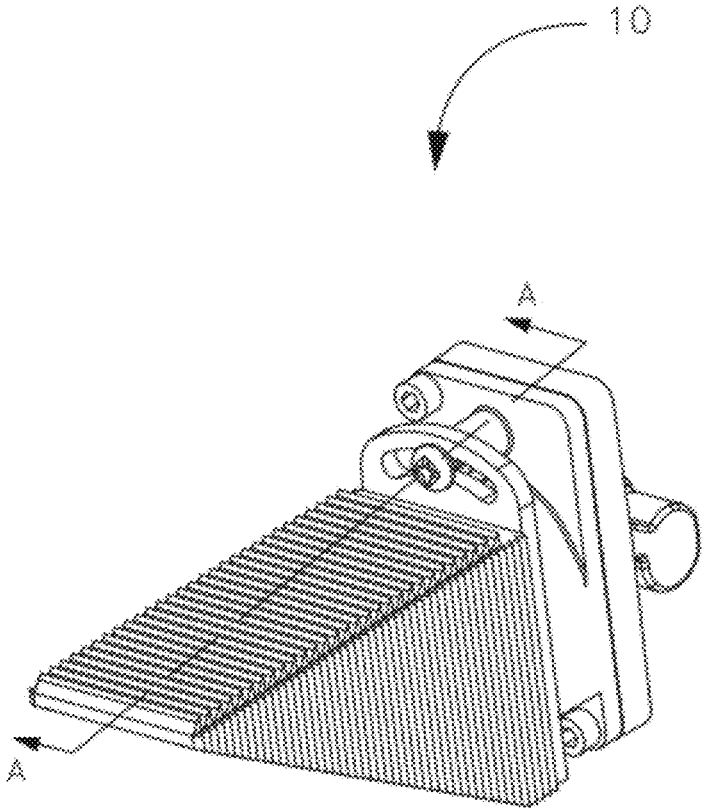
FIG. 1A illustrates an assembled perspective view of an LED module according to aspects of the present invention.
Figure 1B:
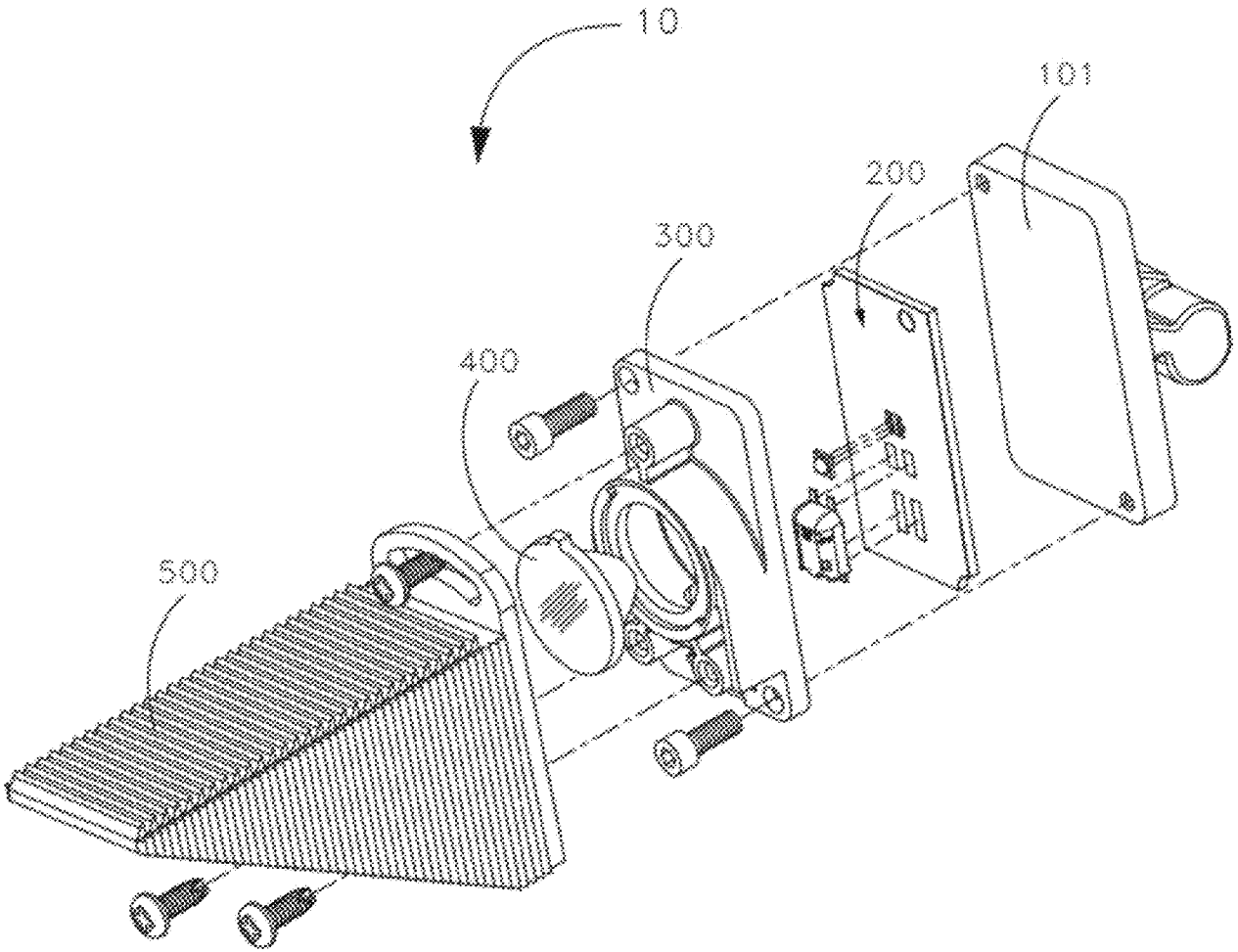
FIG. 1B illustrates the module of FIG. 1A in exploded perspective view.
Figure 1C:
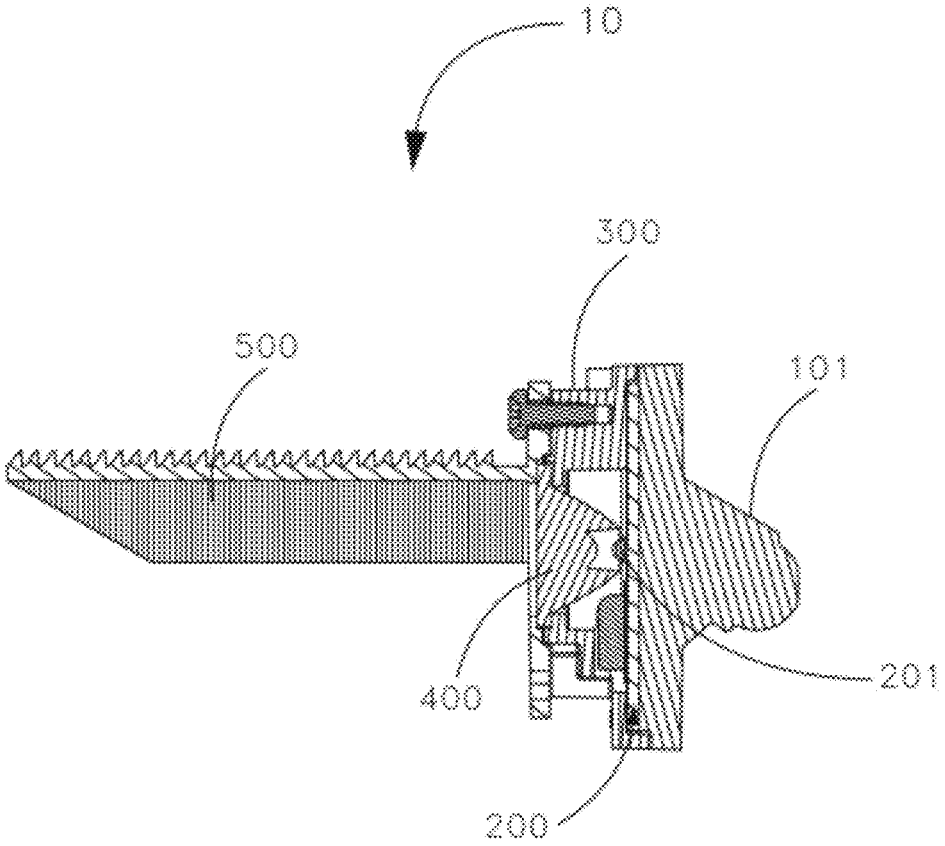
FIG. 1C illustrates the module of FIGS. 1A and B along section line A-A of FIG. 1A.

FIGS. 3A-E illustrate multiple isolated views of the housing of FIGS. 1A-C.

Figure 4A:
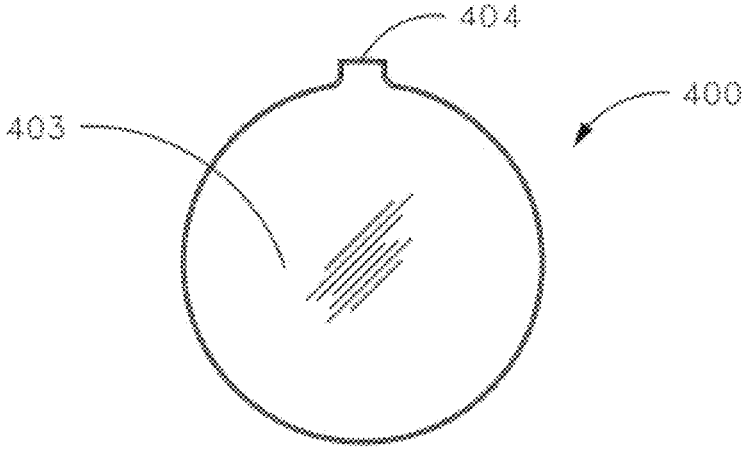
Figure 4B:
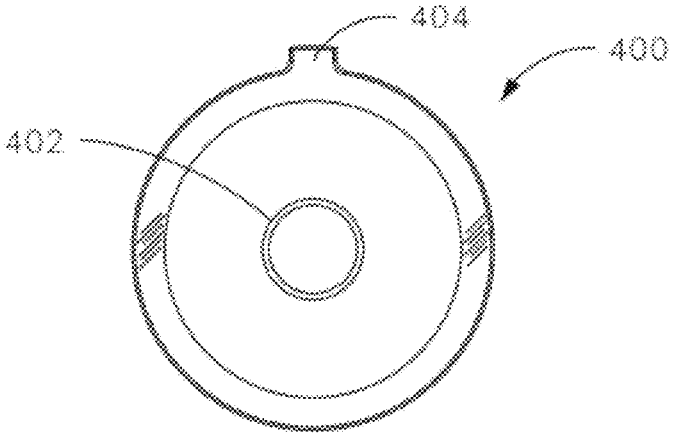
Figure 4C:
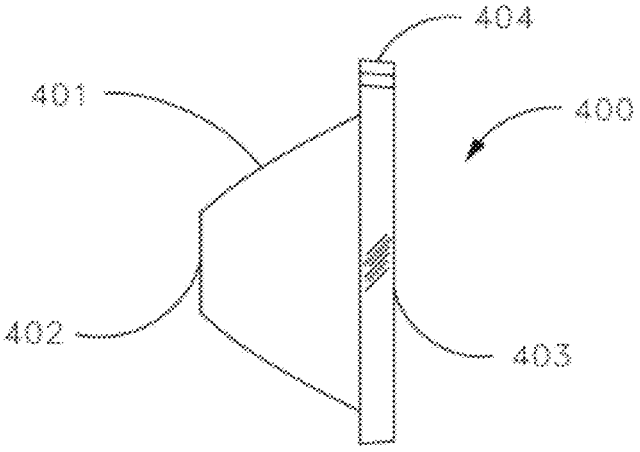

FIGS. 4A-C illustrate multiple enlarged isolated views of the lens of FIGS. 1A-C.

FIGS. 5A-D illustrate multiple isolated views of the visor of FIGS. 1A-C.

FIGS. 5E-I illustrate isolated perspective views of some possible visors for use with the LED module of FIGS. 1A-C.

Figure 6A:
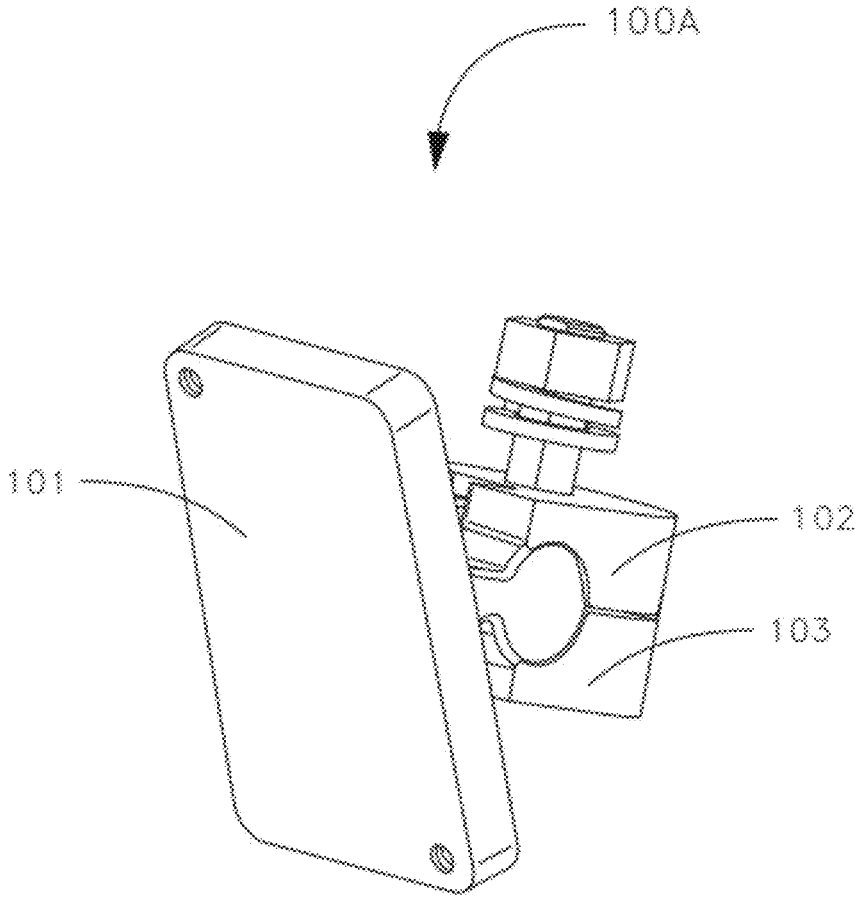

FIG. 6A illustrates an isolated assembled perspective view of one possible design of pivot joint for use in the LED module of FIGS. 1A-C according to aspects of the present invention.

Figure 6B:
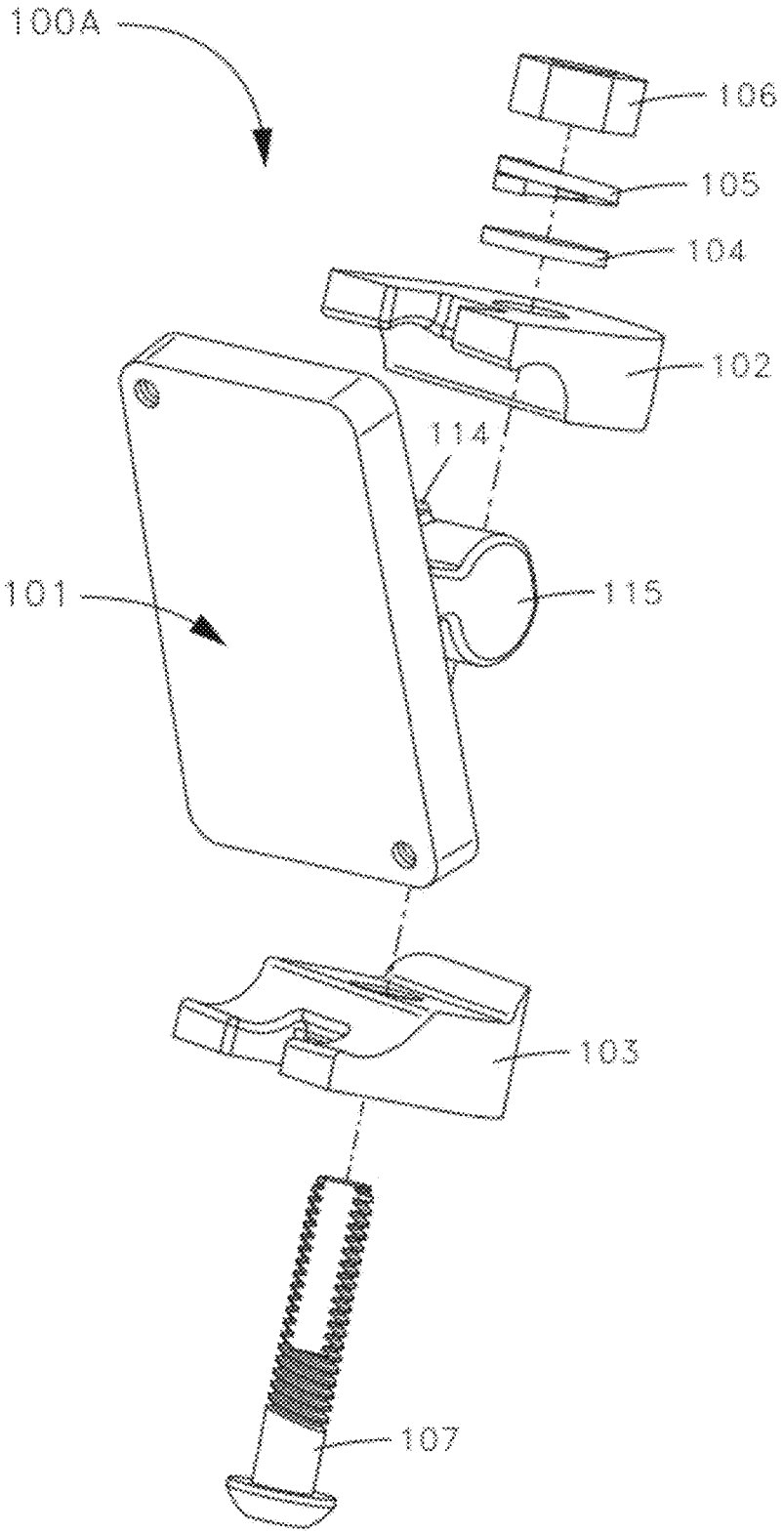

FIG. 6B illustrates the pivot joint of FIG. 6A in exploded perspective view.

Figure 6C:
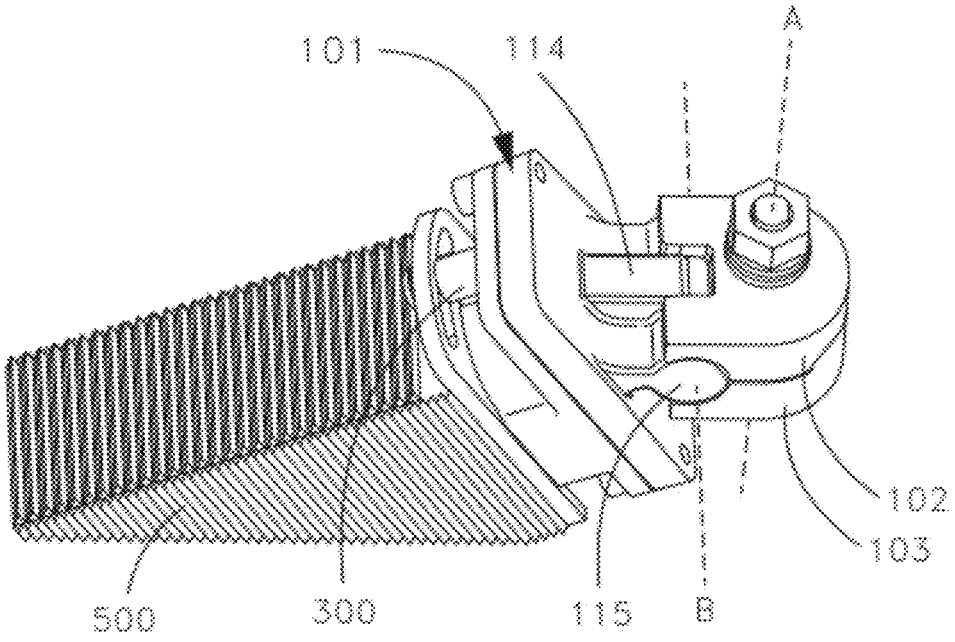
Figure 6D:
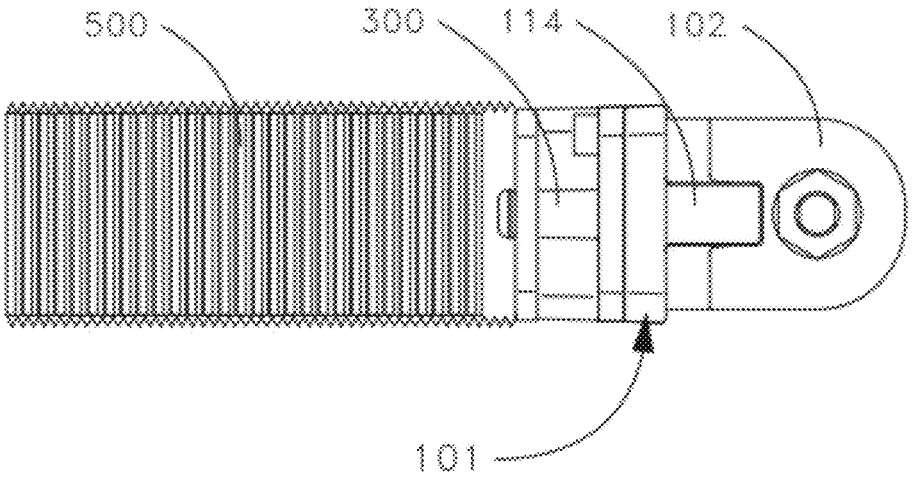

FIGS. 6C and D illustrate multiple views of the pivot joint of FIGS. 6A and B as it may appear in operation.

Figure 6E:
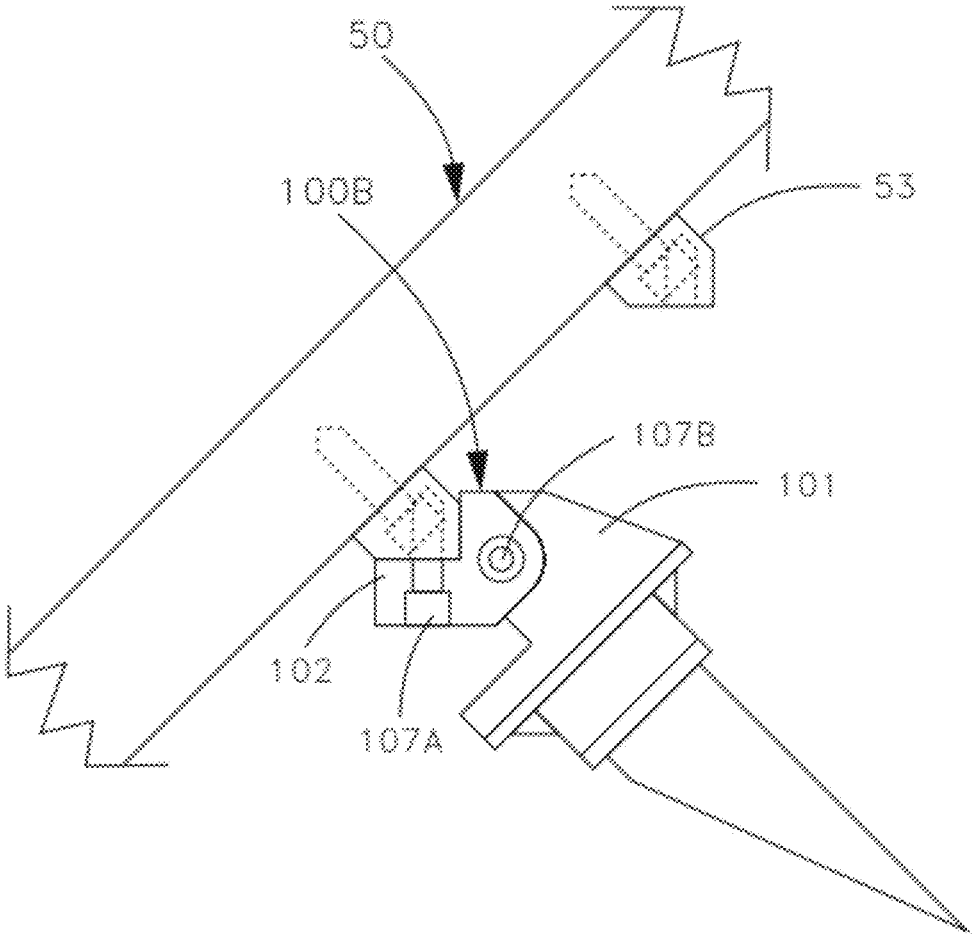

FIG. 6E illustrates an assembled side view of an alternative pivot joint for use in the LED module of FIGS. 1A-C.

Figure 6F:
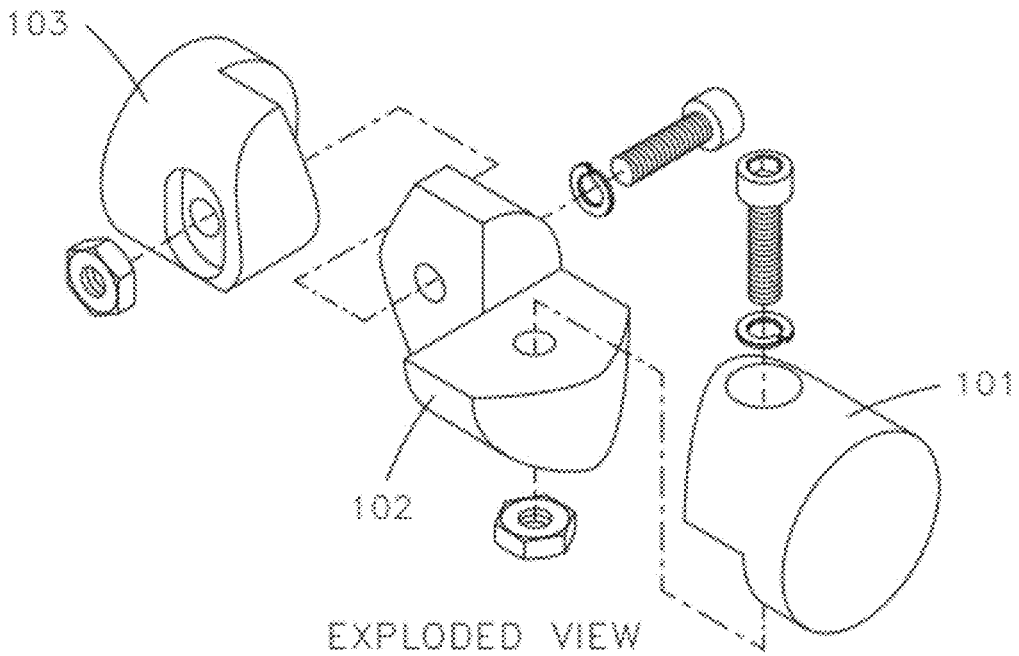
Figure 6G:
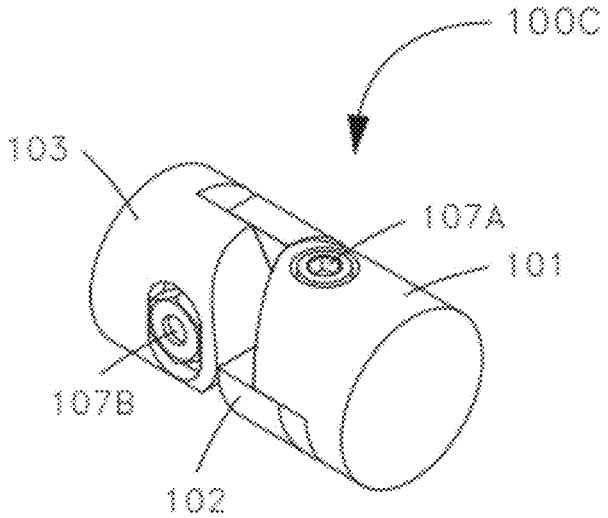

FIGS. 6F and G illustrate multiple views of a still further alternative pivot joint for use in the LED module of FIGS. 1A-C.

Figure 6H:
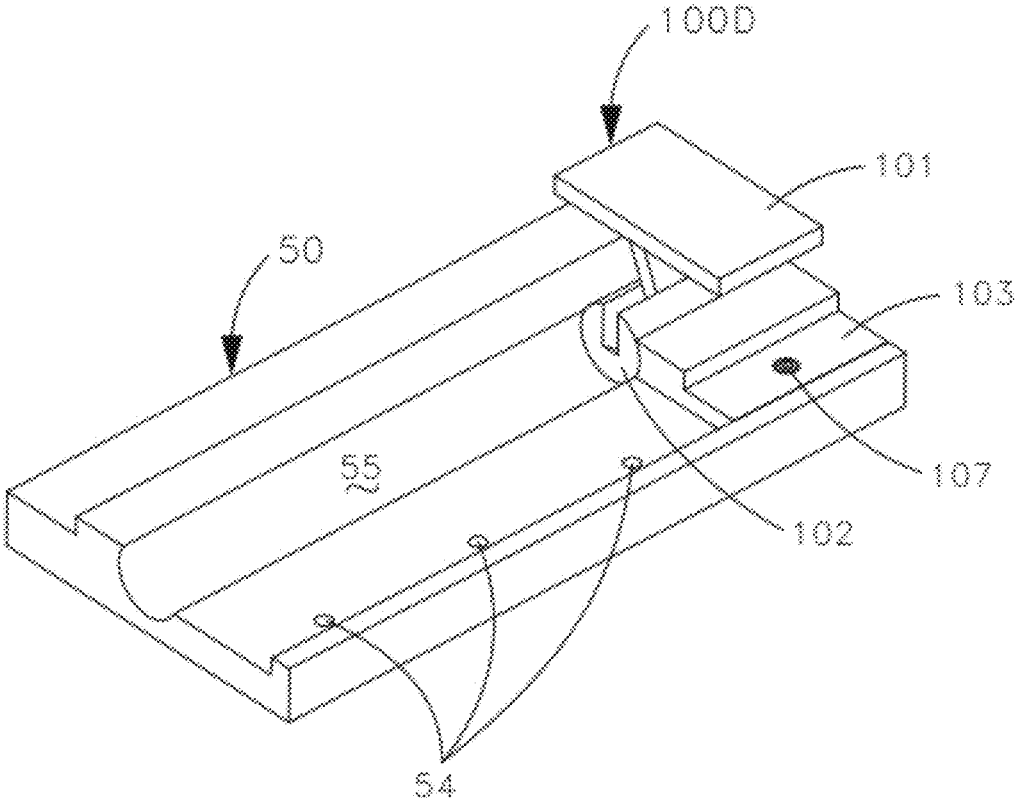

FIG. 6H illustrates an assembled perspective view of a still further alternative pivot joint for use in the LED module of FIGS. 1A-C.

Figure 7:
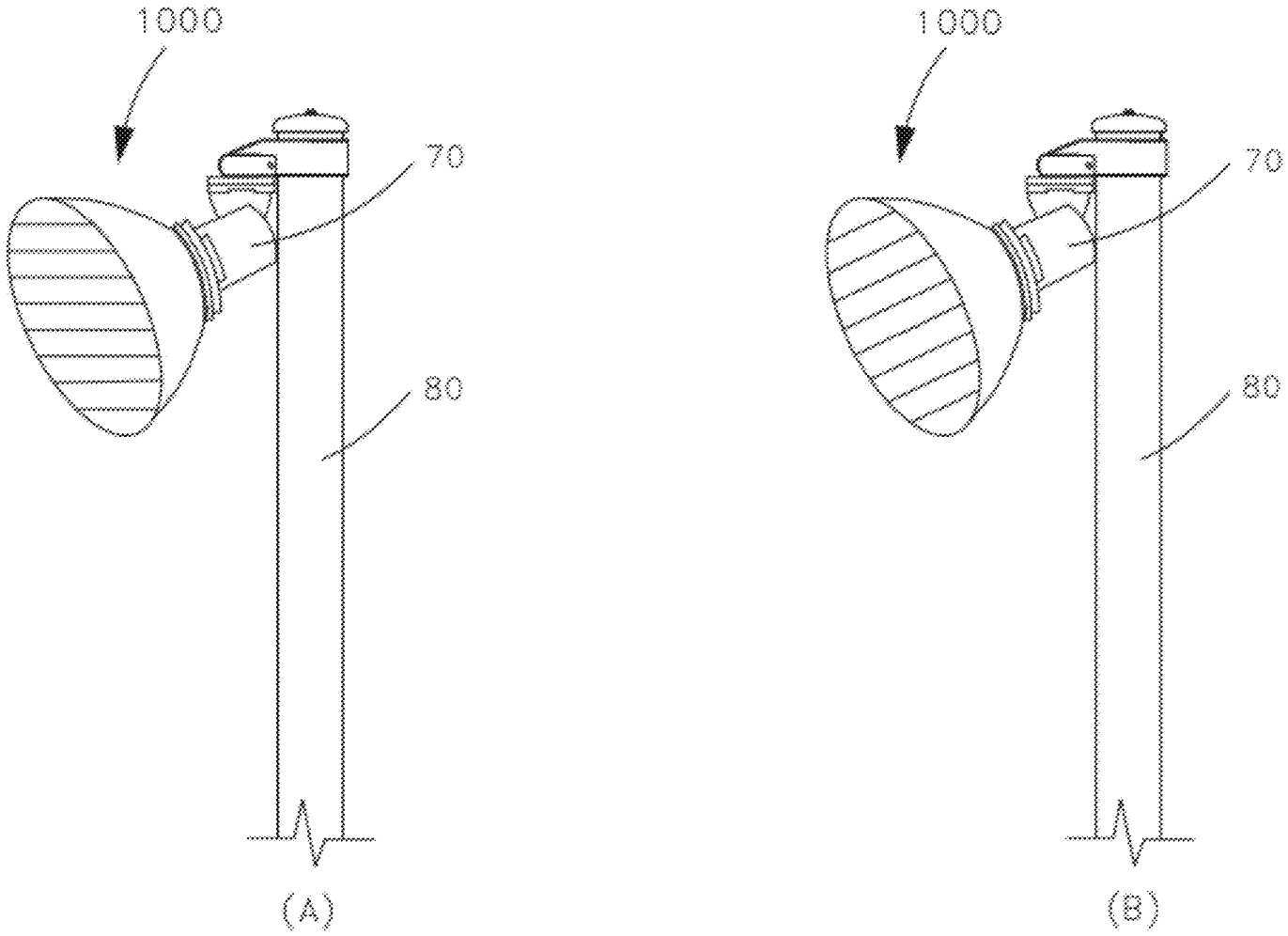
Figure 8B:
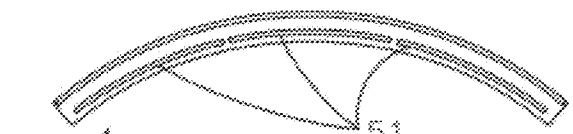
Figure 8D:
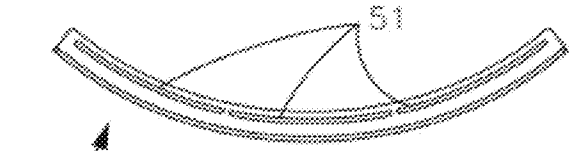
Figure 8G:
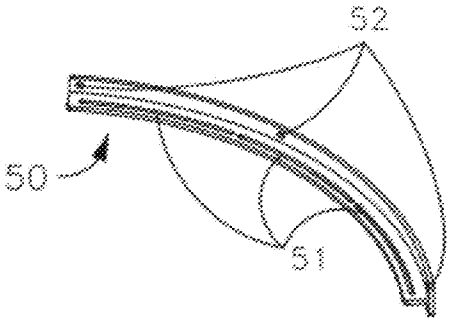
Figure 8A:
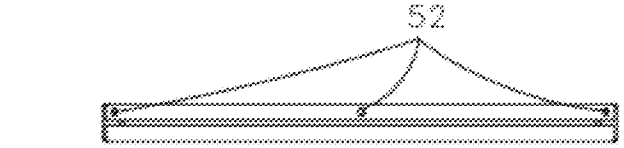
Figure 8C:
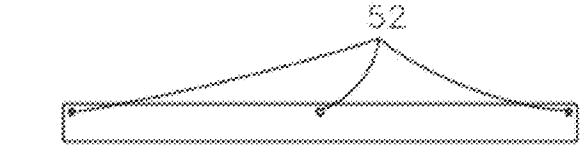
Figure 8E:
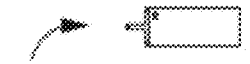
Figure 8F:
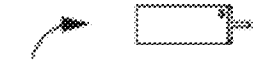

FIG. 7 illustrates two possible methods of aligning module bars within a fixture housing according to aspects of the present invention.

FIGS. 8A-G illustrate multiple isolated views of a module bar according to aspects of the present invention.

Figure 9:
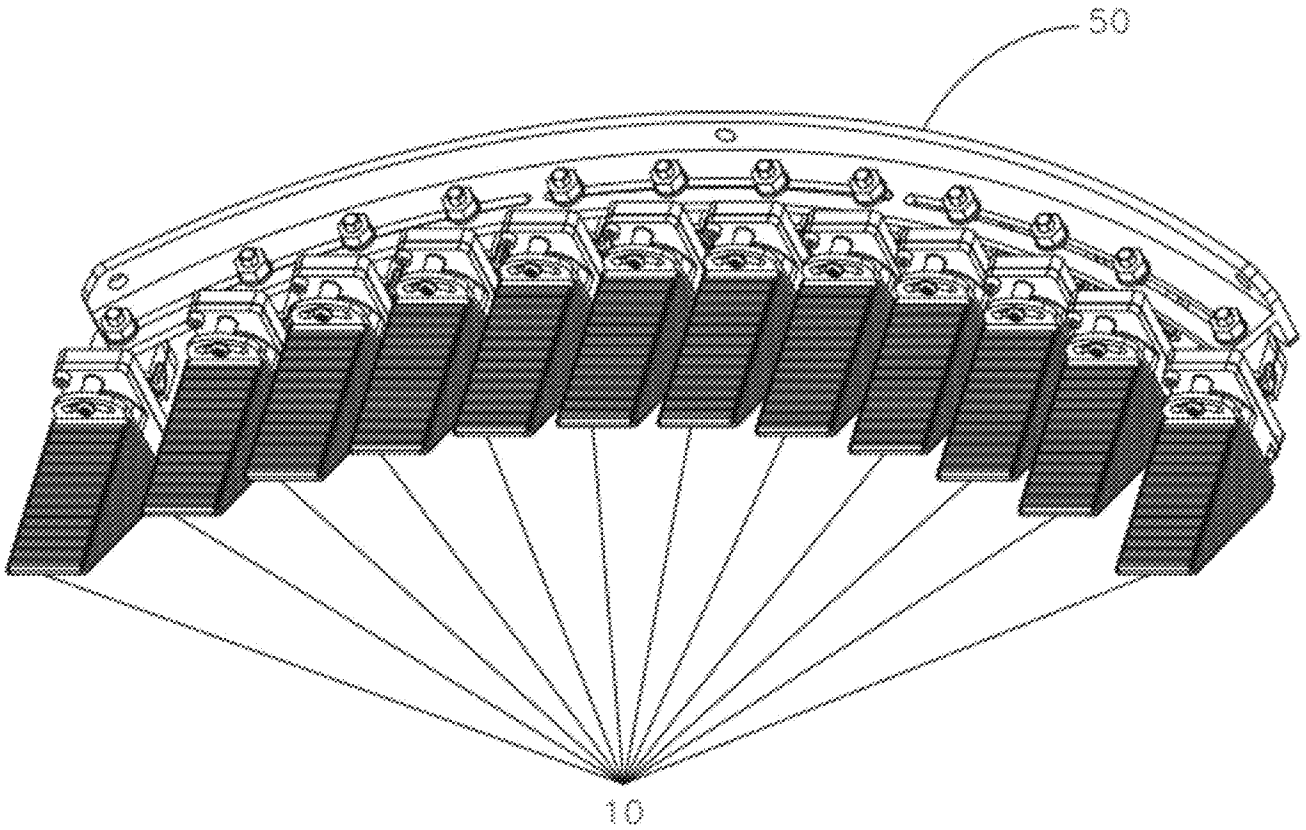

FIG. 9 illustrates an enlarged isolated perspective view of the module bar of FIGS. 8A-G with a plurality of the module of FIGS. 1A-C installed.

Figure 10C:
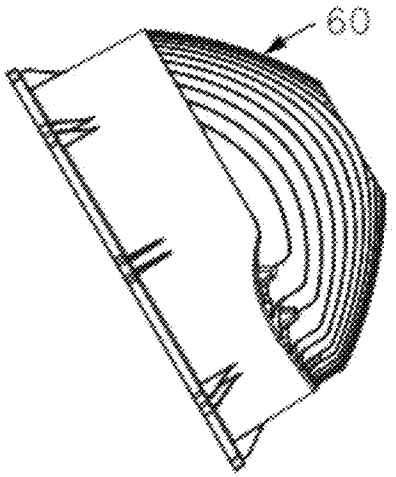
Figure 10B:
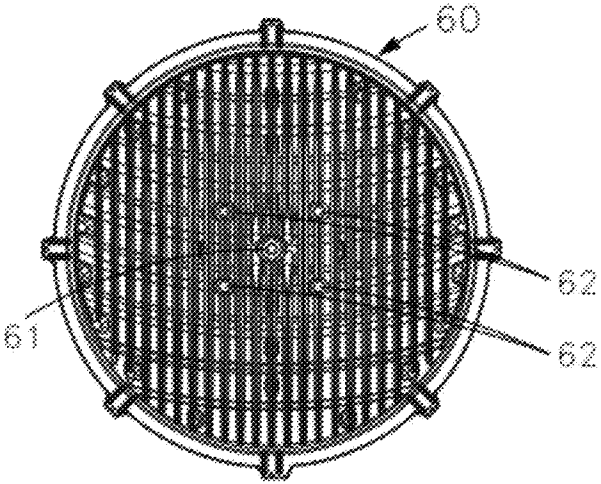
Figure 10A:
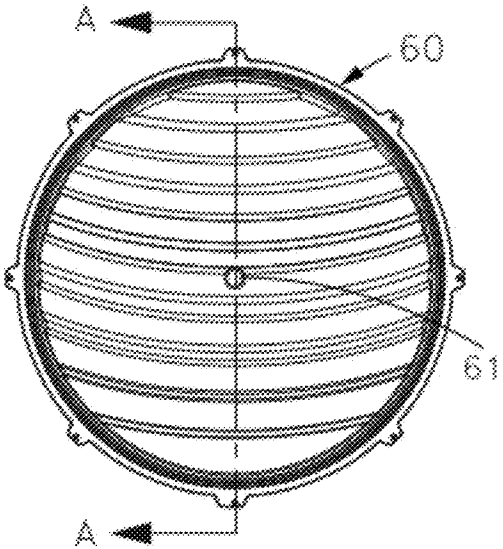

FIGS. 10A-C illustrate multiple isolated views of a fixture housing (aimed at 30° down from horizontal) according to aspects of the present invention.

Figure 10D:
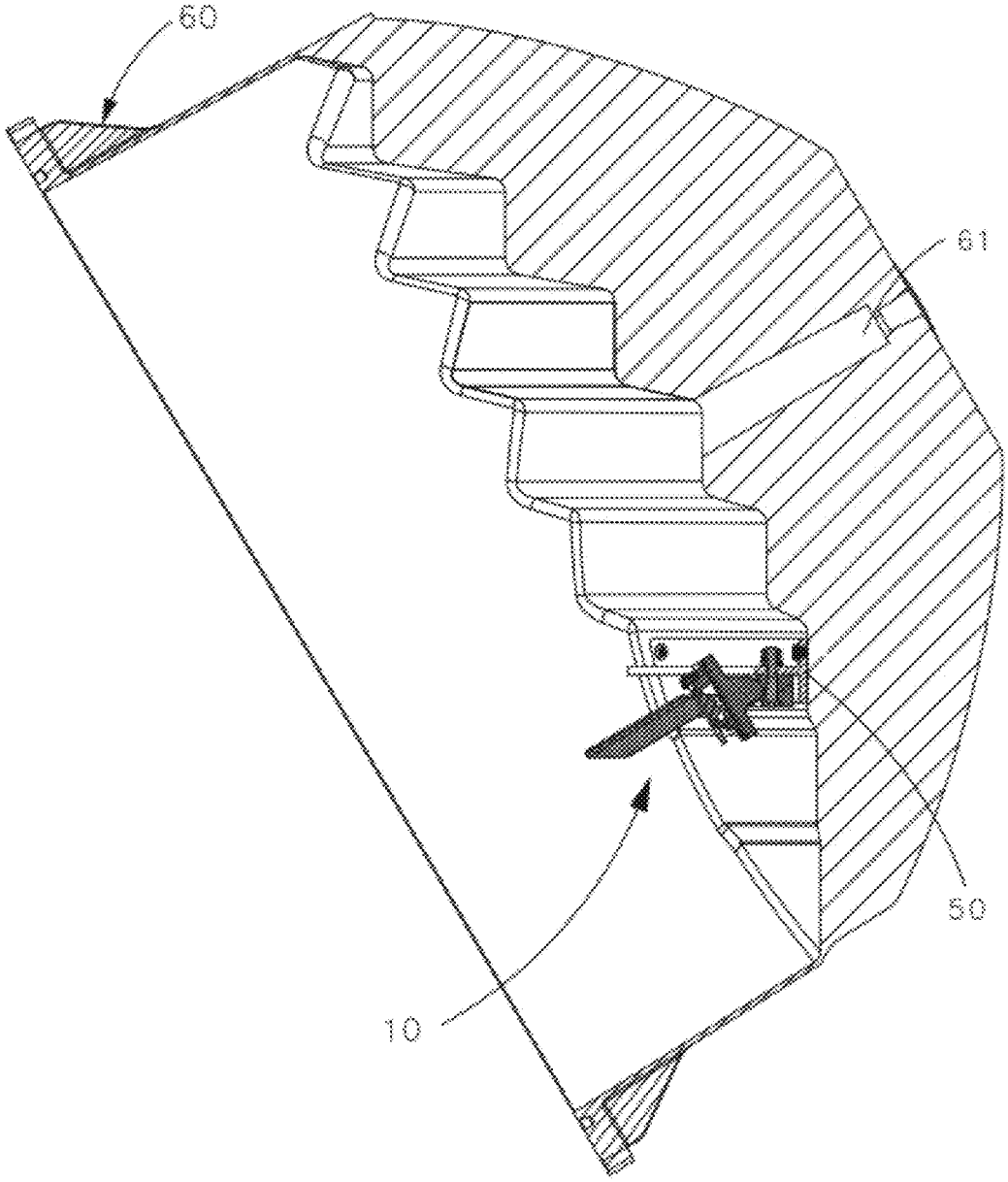

FIG. 10D illustrates an enlarged view of the fixture housing of FIGS. 10A-C along section line A-A and including one module bar (see FIG. 8) and one LED module (see FIGS. 1A-C) installed according to aspects of the present invention.

Figure 11A:
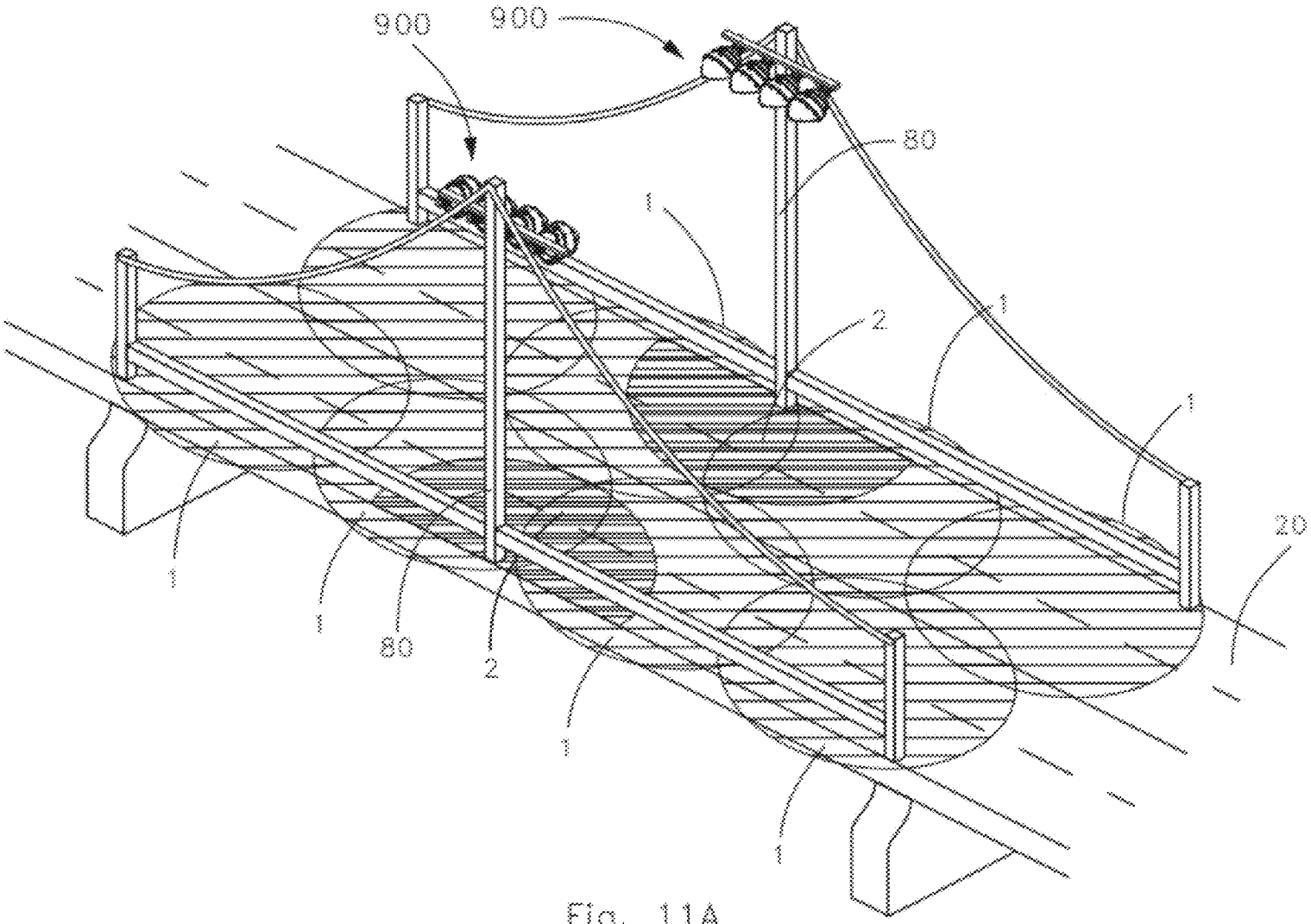

FIG. 11A diagrammatically illustrates a prior art approach to illuminating a roadway.

Figure 11B:
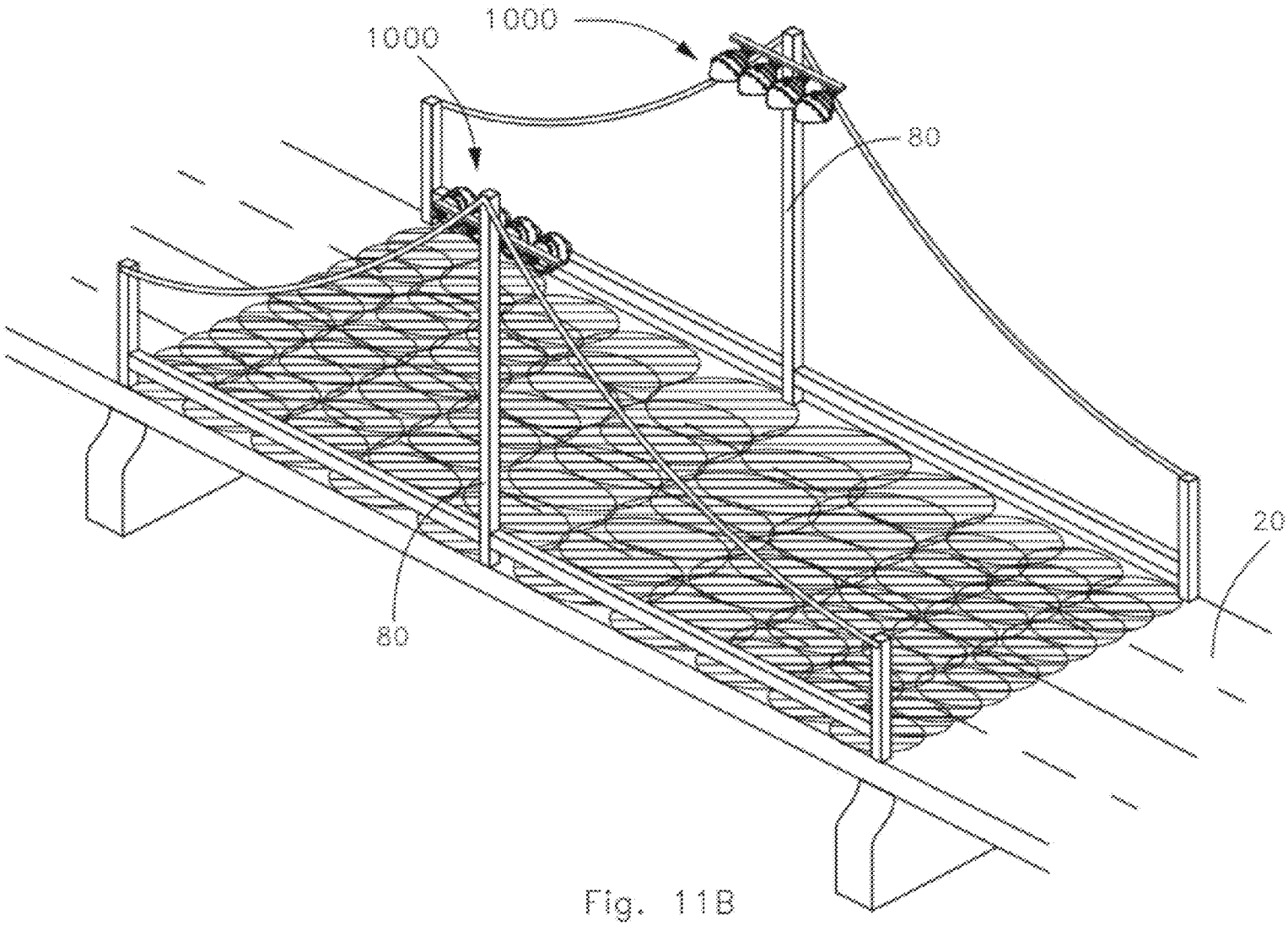

FIG. 11B diagrammatically illustrates one possible approach to illuminating a roadway according to aspects of the present invention.

Figure 12:
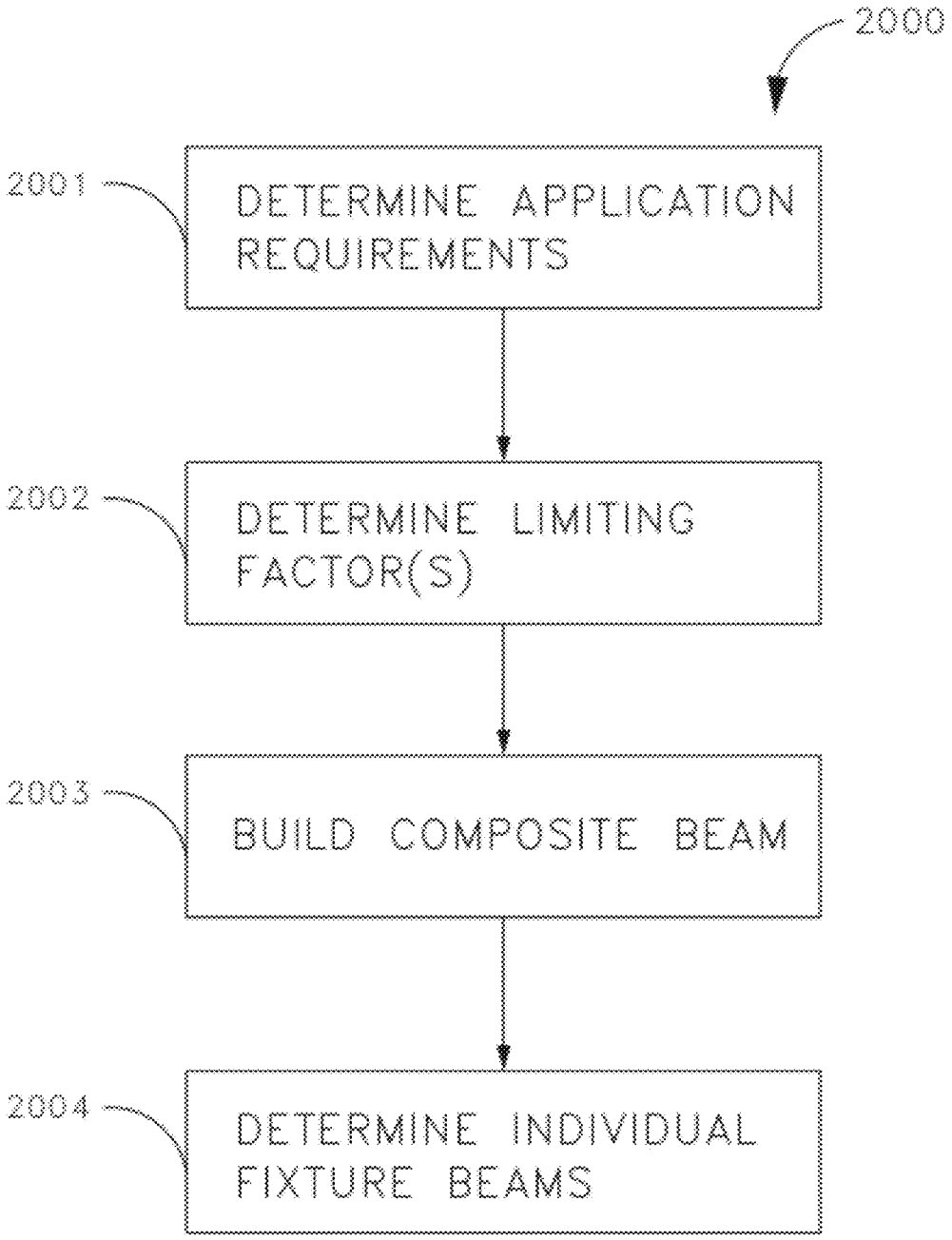

FIG. 12 illustrates in flowchart form one approach to designing a composite beam pattern according to aspects of the invention.

Figure 13:
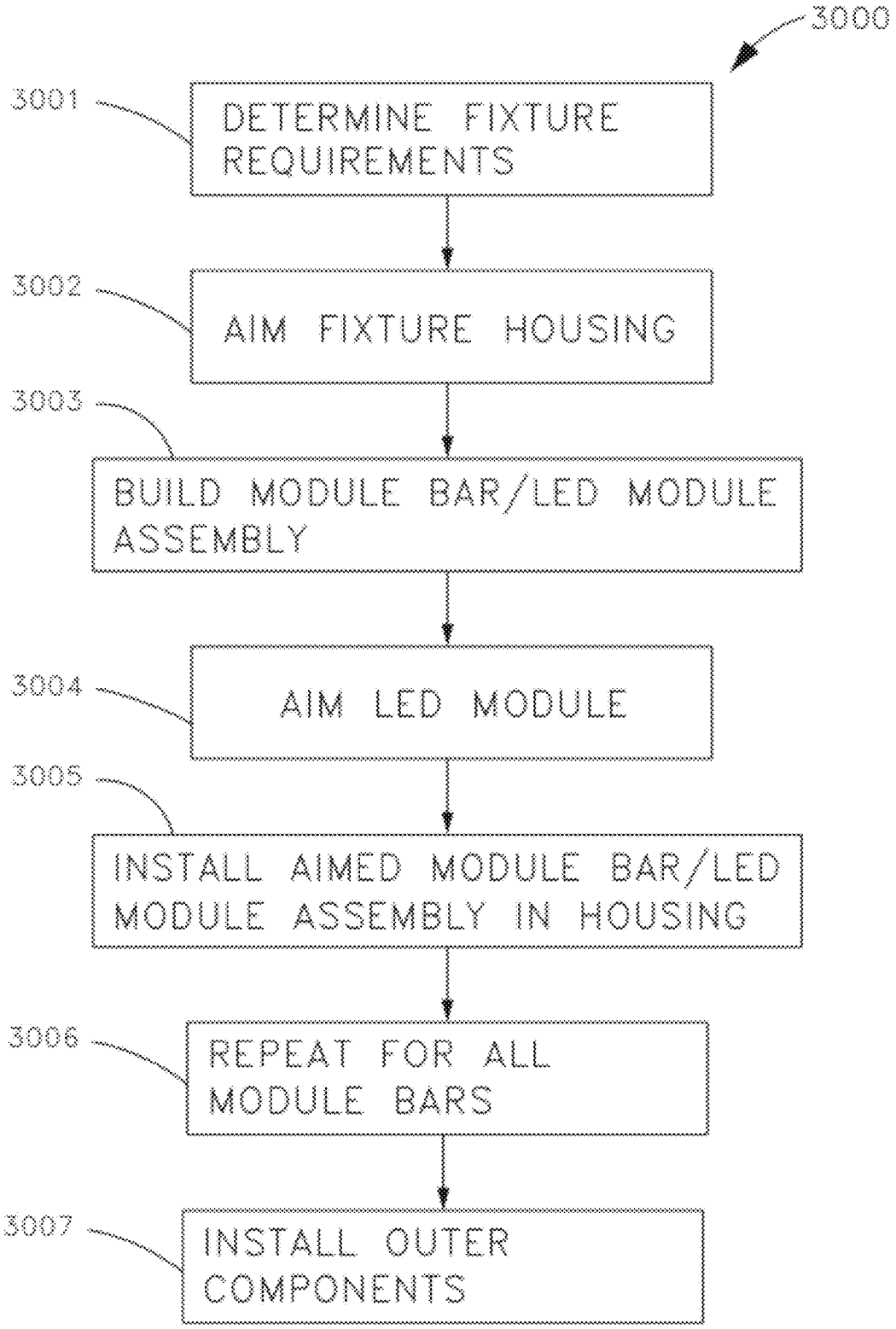

FIG. 13 illustrates in flowchart form one approach to aiming an exemplary fixture to achieve the composite beam pattern designed according to the flowchart of FIG. 12.

Figure 14A:
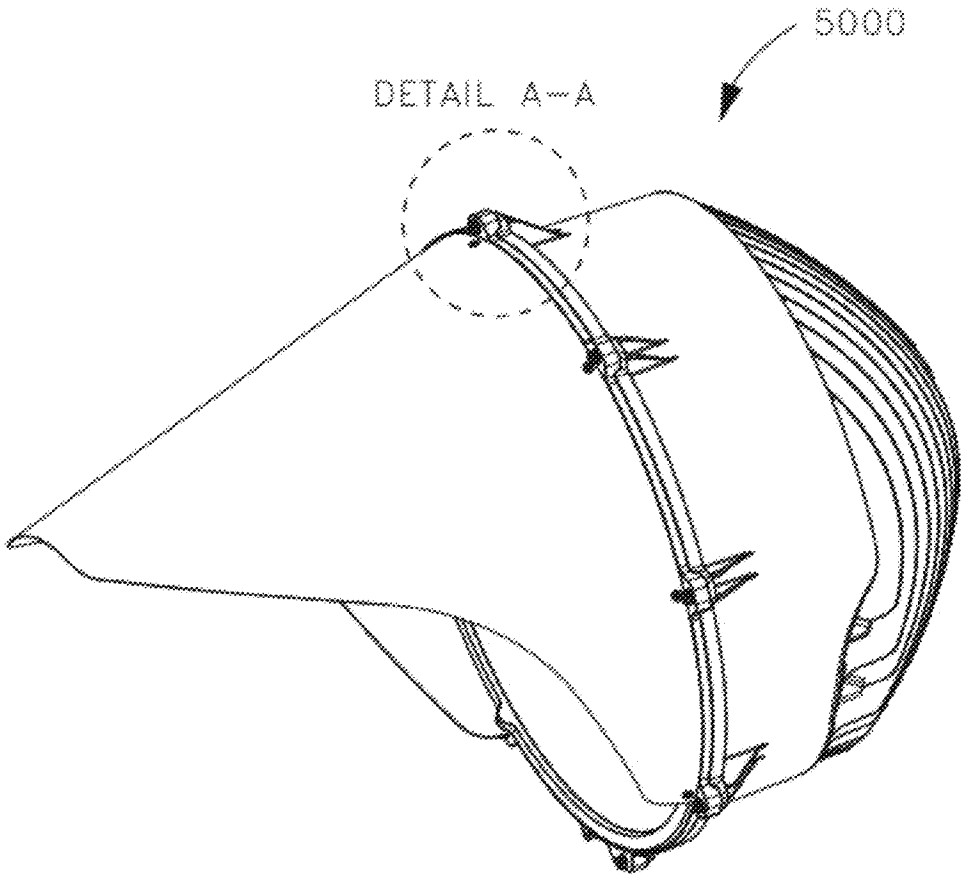

FIG. 14A illustrates an assembled perspective view of an LED fixture according to aspects of the present invention.

Figure 14B:
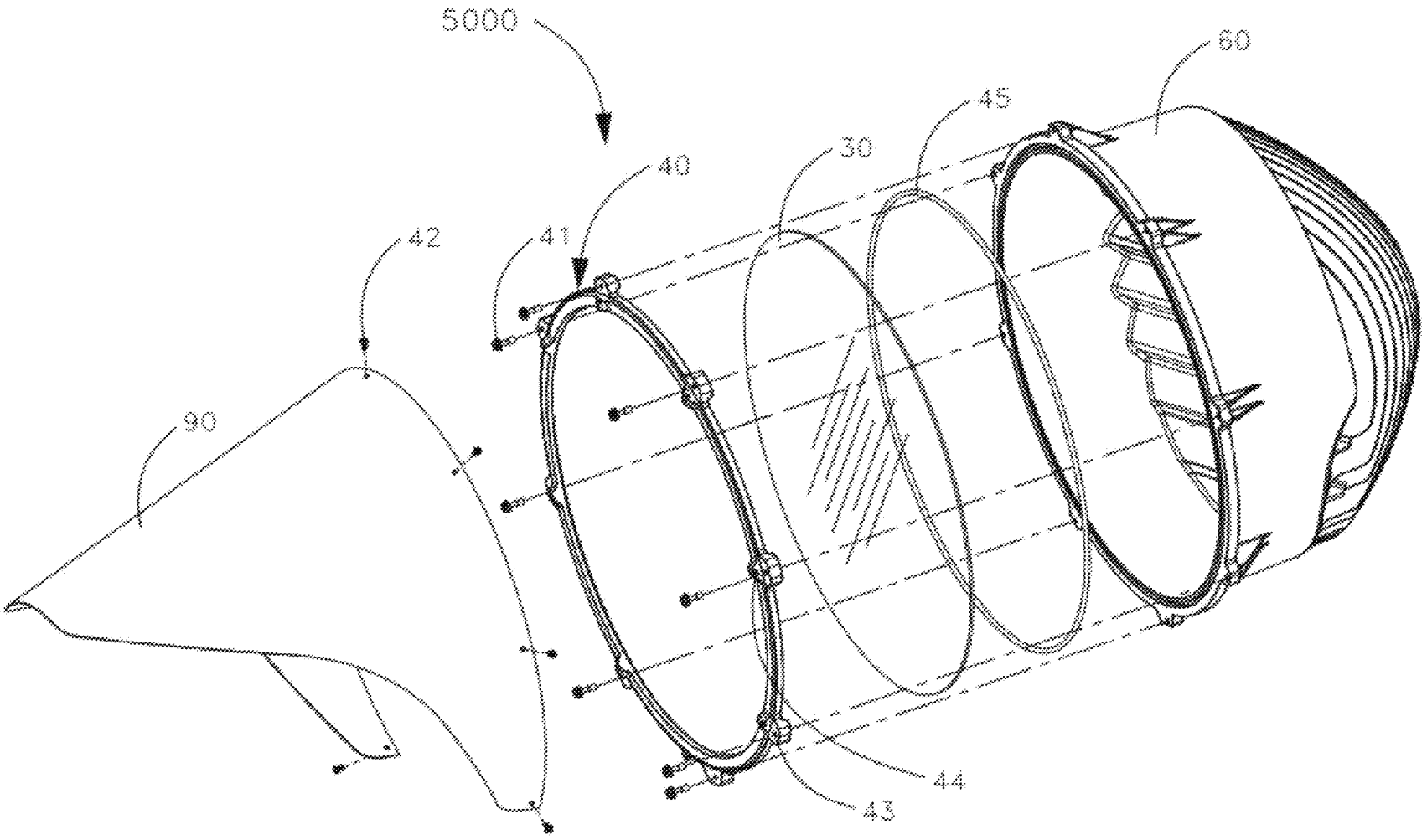

FIG. 14B illustrates an exploded perspective view of the exterior components of the LED fixture of FIG. 14A.

Figure 14C:
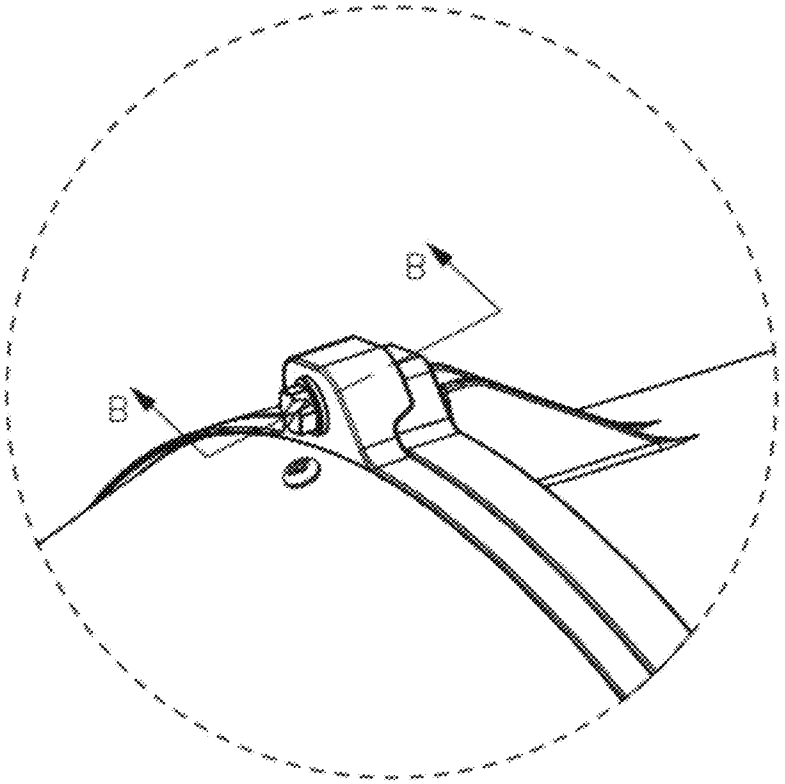

FIG. 14C illustrates an enlarged view of Detail A of FIG. 14A.

Figure 14D:
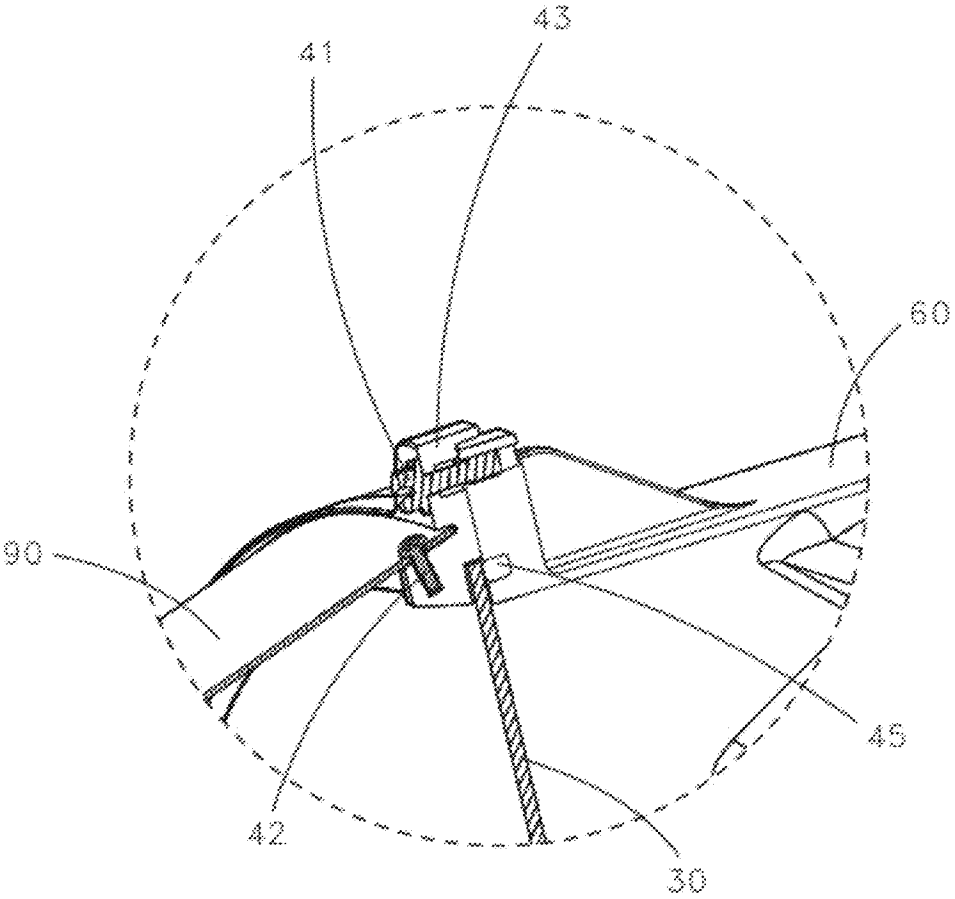

FIG. 14D illustrates the LED fixture of FIG. 14C along section line B-B; for clarity, some hatching has been omitted.

Figure 15A:
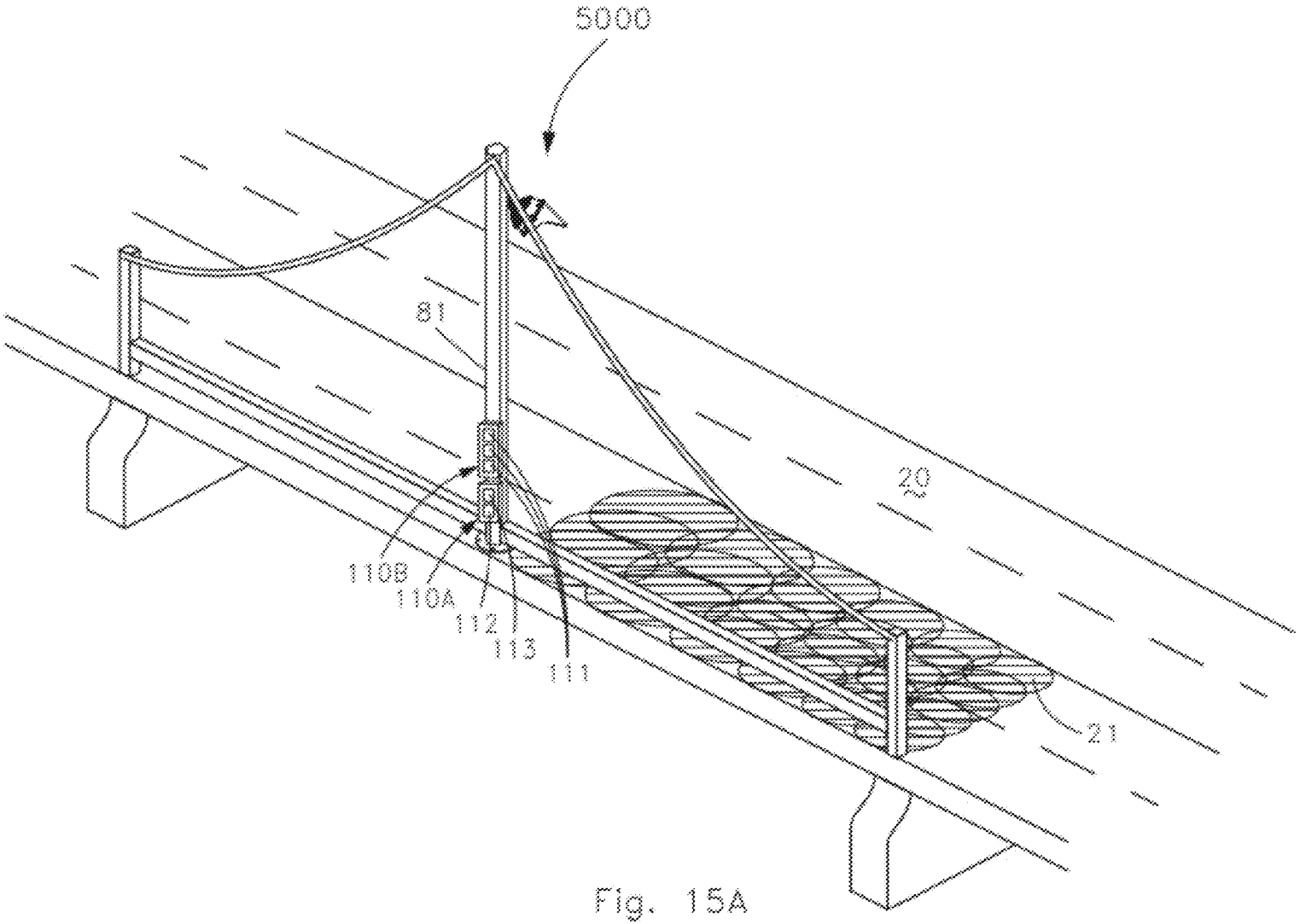

FIG. 15A illustrates portions of an exemplary lighting system according to aspects of the present invention.

Figure 15B:
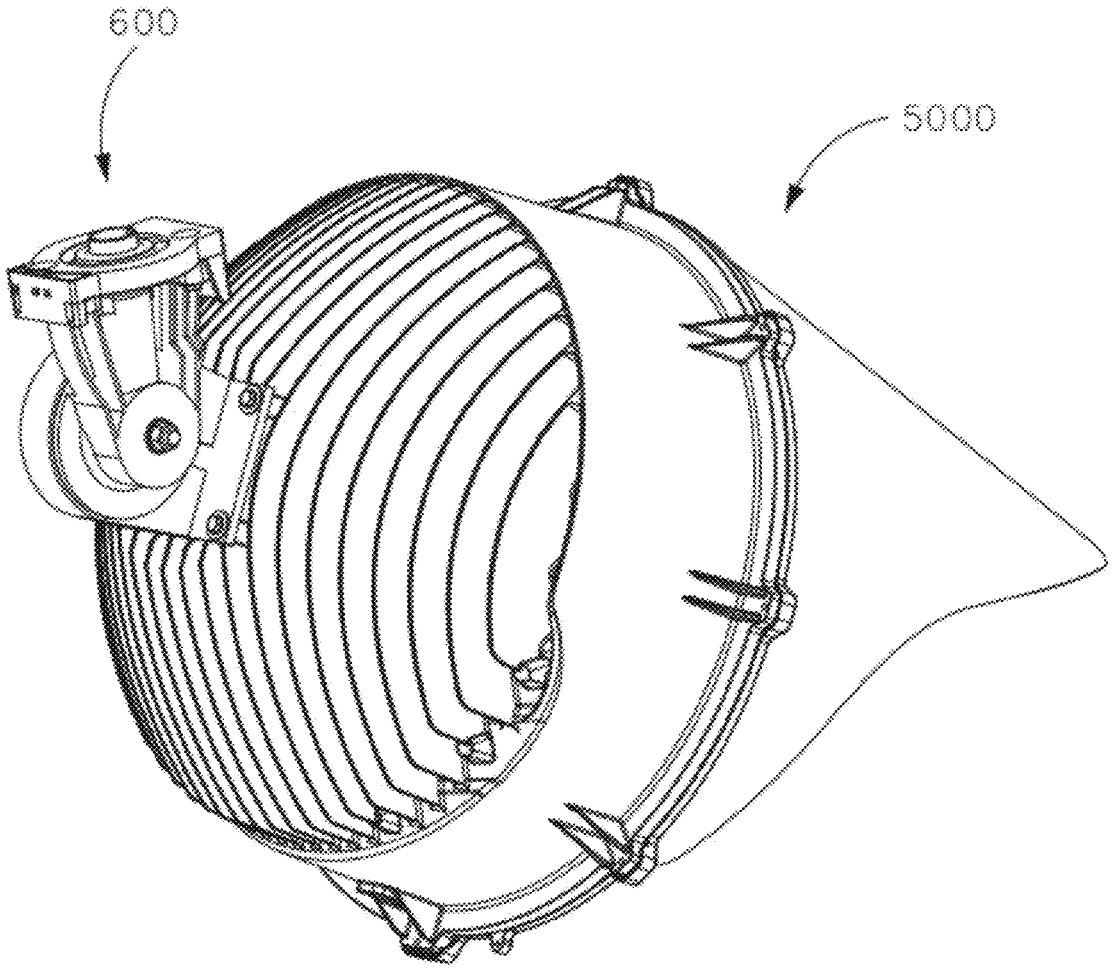

FIG. 15B illustrates an enlarged isolated perspective view of the exemplary fixture and exemplary knuckle of FIG. 15A.

Figures 15C, 15D:
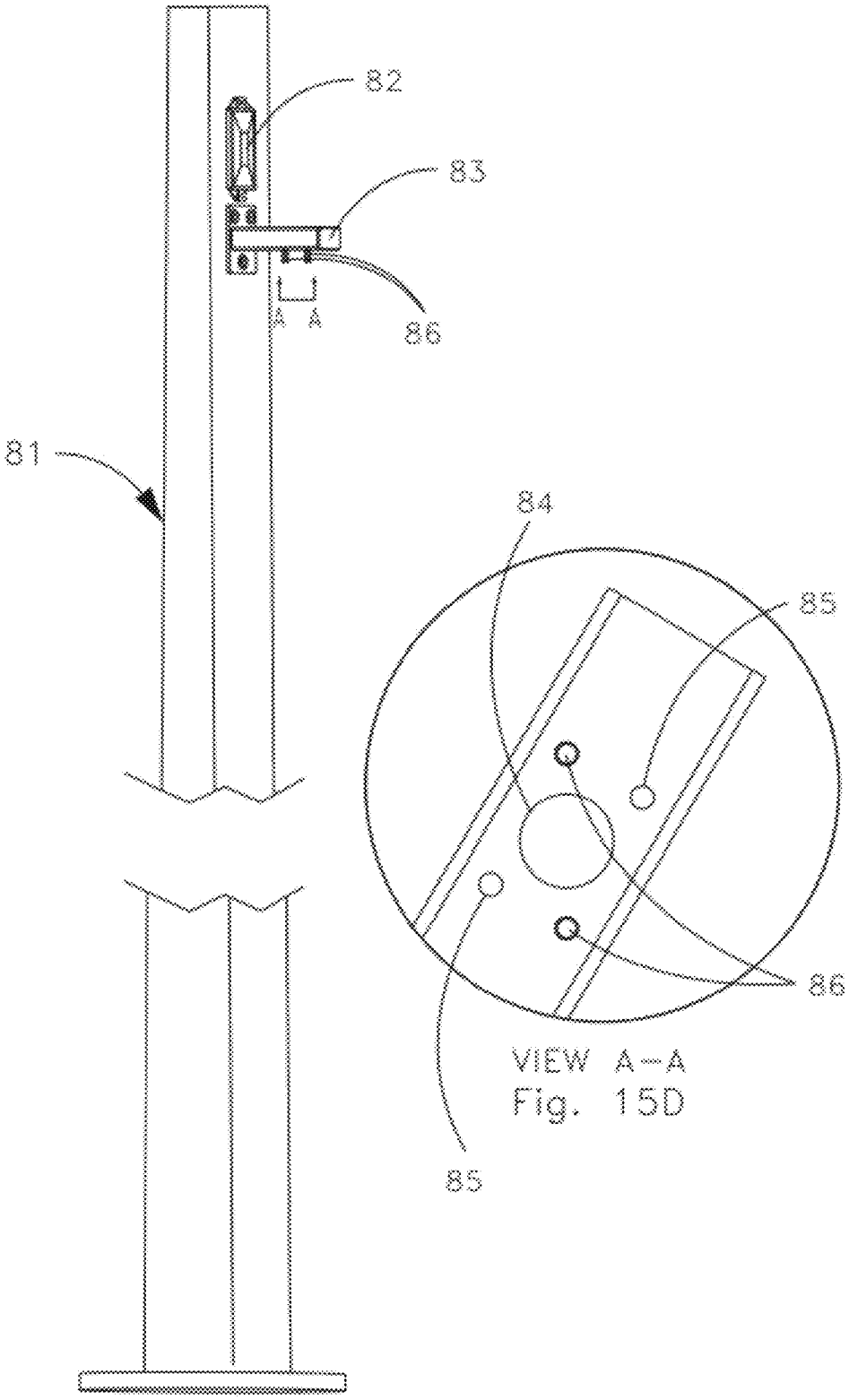

FIGS. 15C and D illustrate an isolated perspective view, as well as along view line A-A, of the pole of FIG. 15A.

Figure 15E:
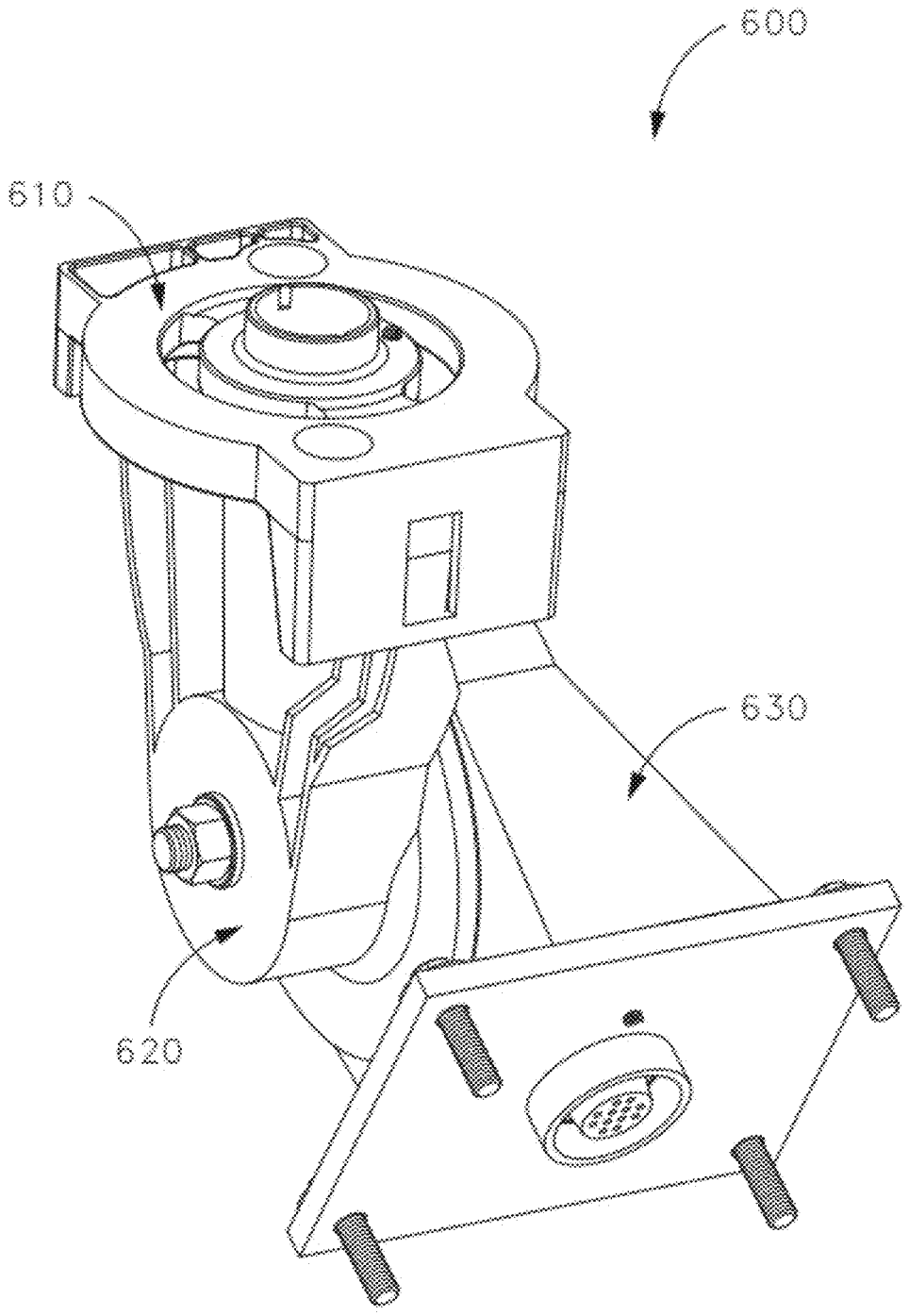

FIG. 15E illustrates an enlarged isolated assembled perspective view of the exemplary knuckle of FIG. 15B.

Figure 15F:
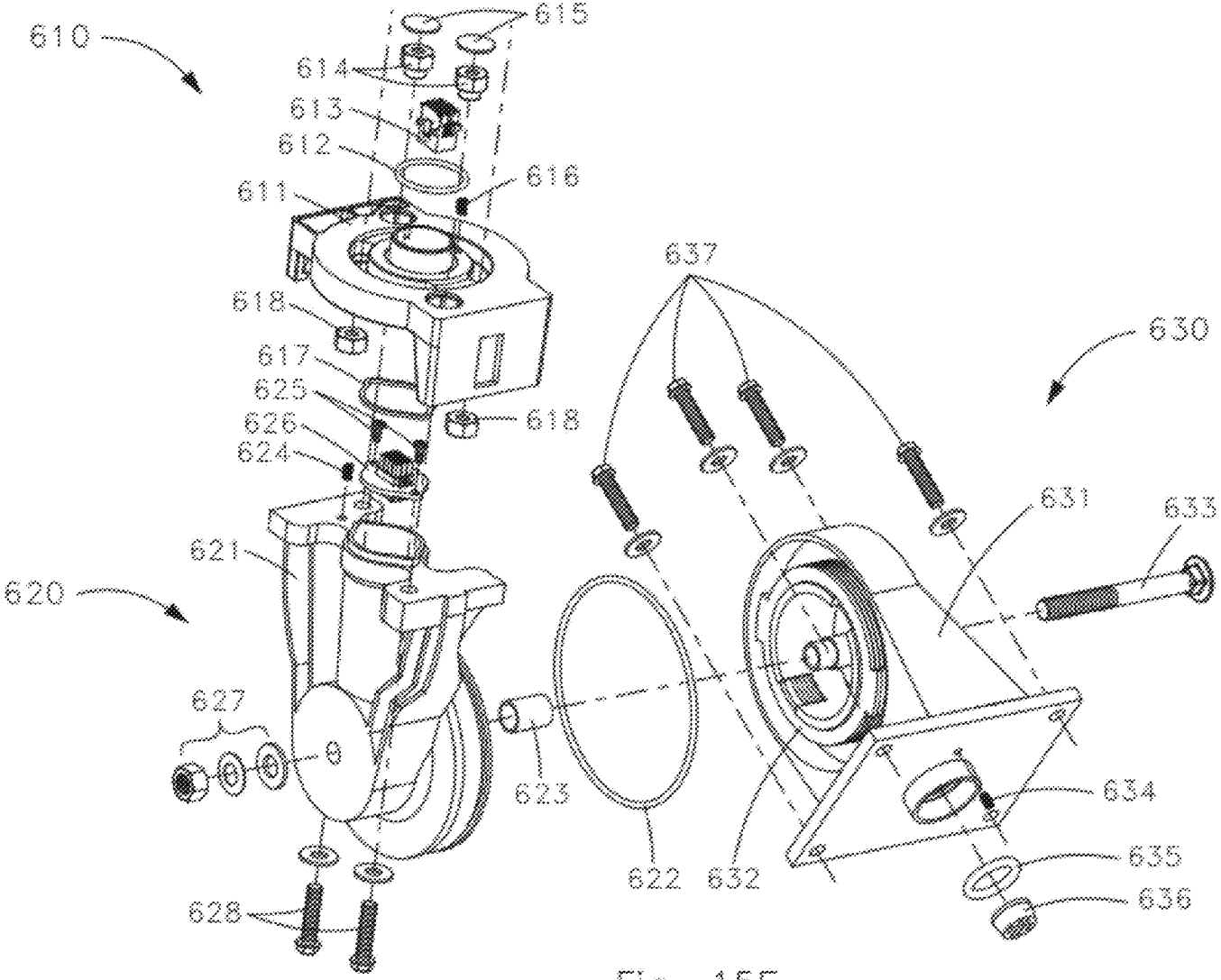

FIG. 15F illustrates a partially exploded view of the exemplary knuckle of FIG. 15E.

Figure 16:
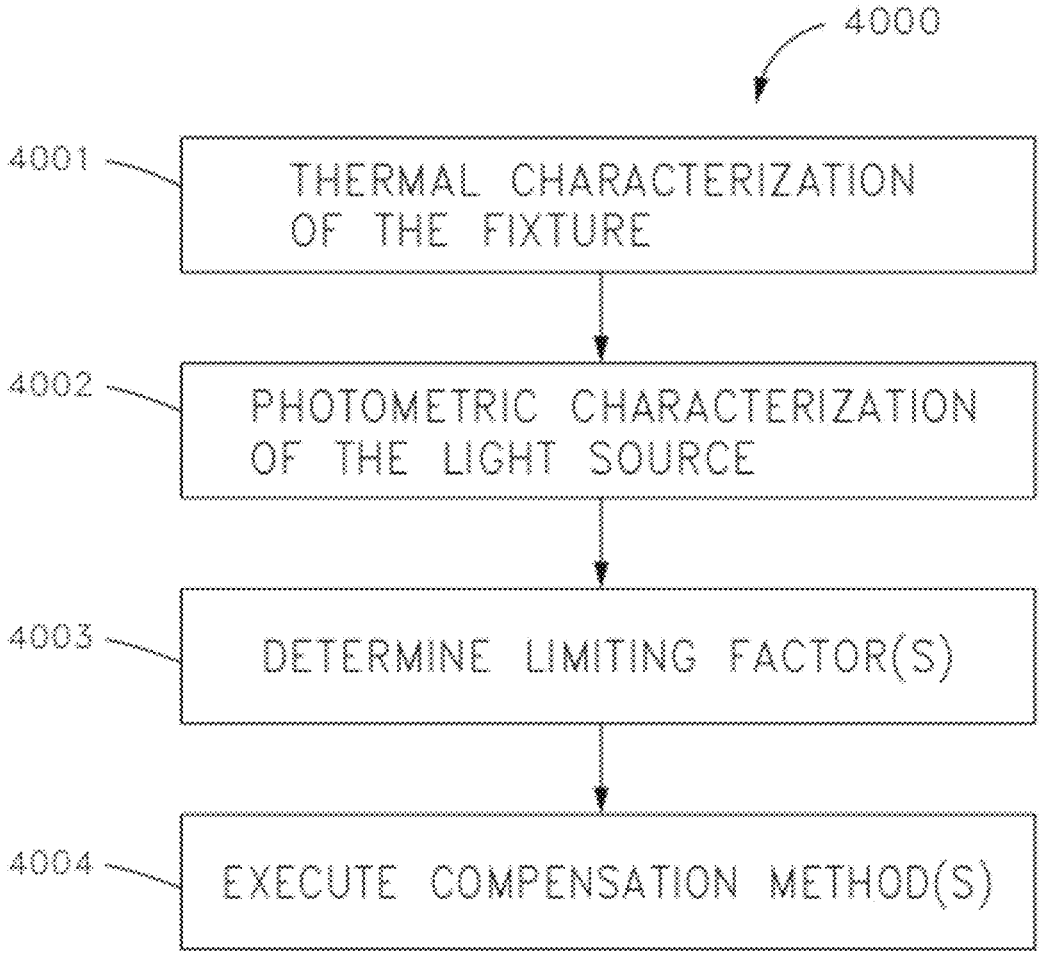

FIG. 16 illustrates in flowchart form a method of operating the exemplary lighting system of FIGS. 15A-F according to aspects of the present invention.

Figure 17:
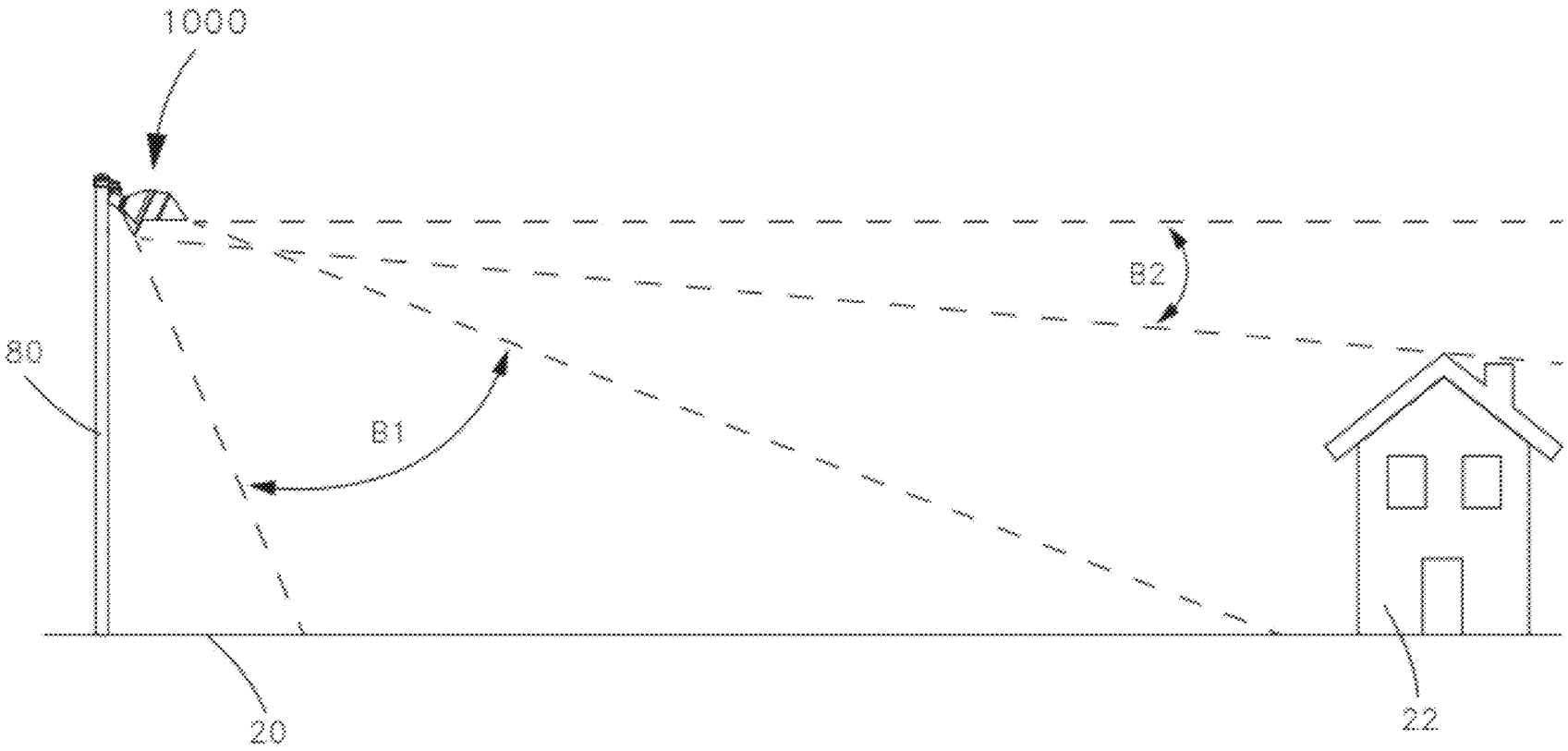

FIG. 17 diagrammatically illustrates one method of providing both uplighting and directional (i.e., task) lighting for an application according to aspects of the present invention.

Figure 18A:
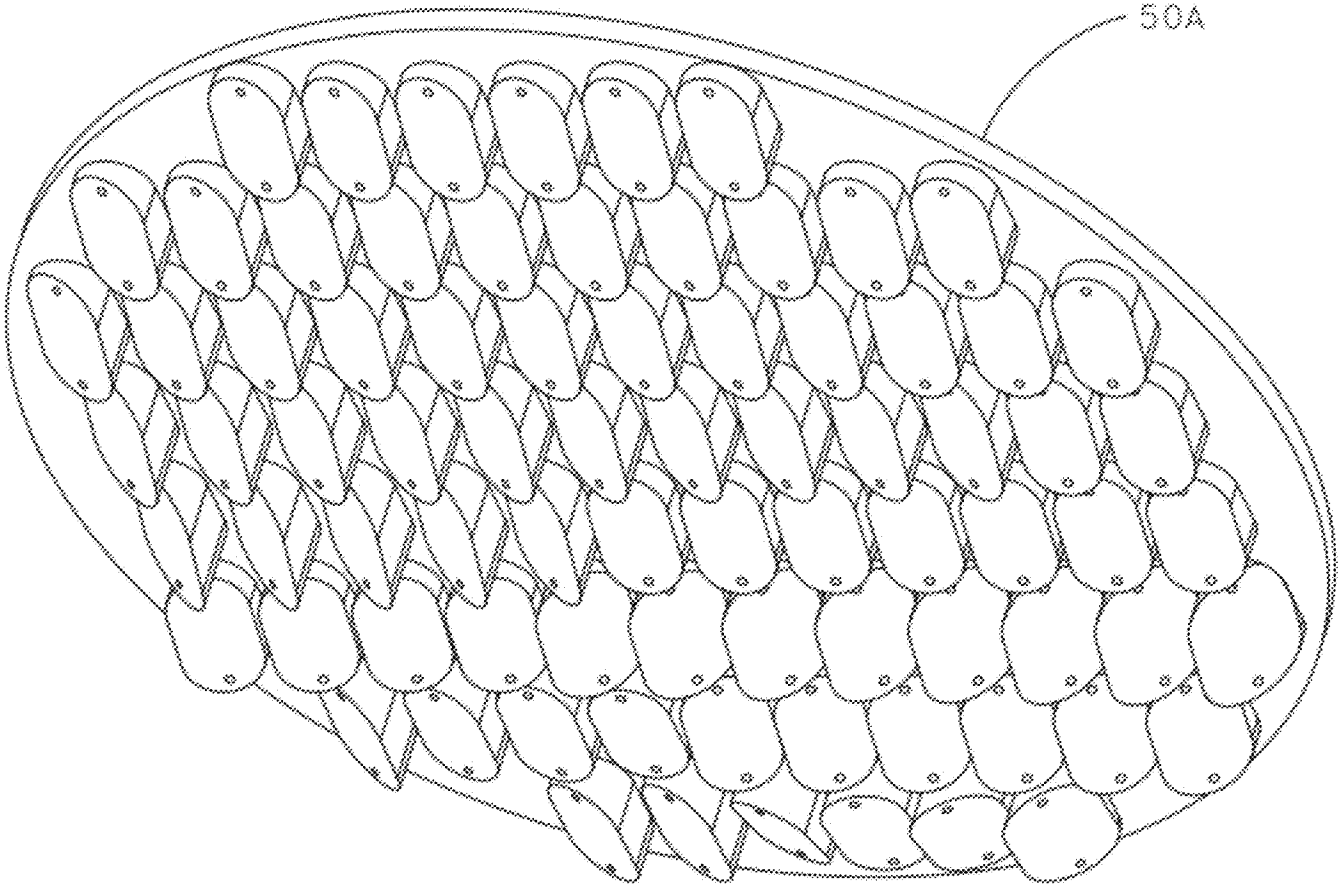

FIG. 18A illustrates an alternative to the module bar of FIG. 8.

Figure 18B:
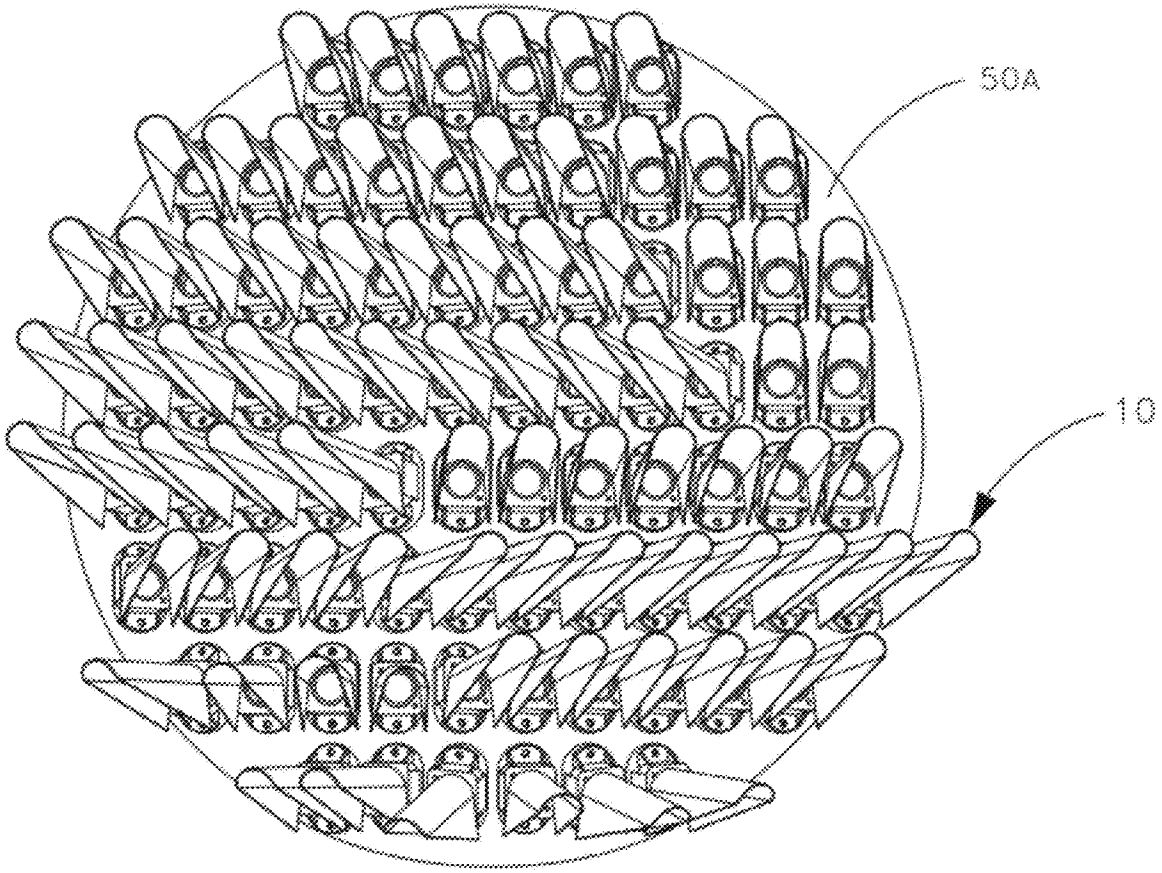

FIG. 18B illustrates an alternative to the module bar and LED modules of FIG. 9.

IV. DETAILED DESCRIPTION OF EXEMPLARY EMBODIMENTS

To further an understanding of the present invention, specific exemplary embodiments according to the present invention will be described in detail. Frequent mention will be made in this description to the drawings. Reference numbers will be used to indicate certain parts in the drawings. The same reference numbers will be used to indicate the same parts throughout the drawings.

Envisioned are apparatus, methods, and systems for reasonably ensuring operation of a large-scale outdoor LED lighting system over a defined period of time at a relatively constant light level. LEDs offer many benefits including long operating life, RoHS and LEED compliance, no restrike downtime, good color stability even across dimming levels, and high efficacy to name a few. That being said, it is to be understood that aspects of the present invention could be applied to other lighting applications, other types of light sources, and the like. Further, while a variety of options and alternatives have been laid out, these are not to be considered limiting or all-encompassing.

It is believed that a comprehensive understanding of the present invention is best achieved by first understanding the components which, along with the envisioned methodology, form the envisioned long-term LED lighting system; the remaining Specification is laid out as such, but is not intended to imply a specific assembly order or sequencing of events unless otherwise stated.

Regarding terminology, it is to be understood that the terms "luminaire" and "fixture" are used interchangeably in this Specification and are intended to encompass the sum of modules and associated exterior components. A grouping of luminaires or fixtures (typically on the same elevating structure) are referred to as an array, whereas the term "lighting system" refers to the sum of luminaires or fixtures, elevating structures, means for affixing luminaires or fixtures to elevating structures, power regulating components, control components, and the like. The term "reasonably ensure" is used throughout this Specification and is intended to mean assurance or near assurance of a condition, event, or the like except in cases of extreme operating conditions (e.g., driving LEDs far beyond rated capacities), extreme environmental conditions (e.g., blizzards), acts of God (e.g., earthquakes), or the like. The term "relatively constant light" is used throughout this Specification and is intended to mean light that is perceived by the average human eye as constant, regardless of whether said light is constant from a lumen output standpoint. Lastly, the terms "beam output pattern", "beam pattern", "output pattern", "light pattern", "beam output", and "light output pattern" are used interchangeably in this Specification and are intended to define the shape, size, and/or nature of light emitted from a source. In some cases said source may comprise a single LED and in others cases said source may comprise a single fixture which houses a plurality of LEDs and associated devices which shape the light projected therefrom; when juxtaposed, the beams are often referred to as "individual" and "composite", respectively.

A. LED Modules

At the core of the envisioned LED lighting system is a number of LED modules. As can be seen from FIGS. 1A-C, module 10 comprises a circuit board 200 which is seated in one end of a housing 300, housing 300 being affixed to pivot joint half 101 (e.g., via screws as shown or otherwise) so to encapsulate circuit board 200. LED module 10 further comprises a lens 400 which is seated in the generally opposite end of housing 300, lens 400 being further positionally secured by a visor 500; visor 500 may be affixed to housing 300 via screws (as shown) or otherwise.

Figure 2:
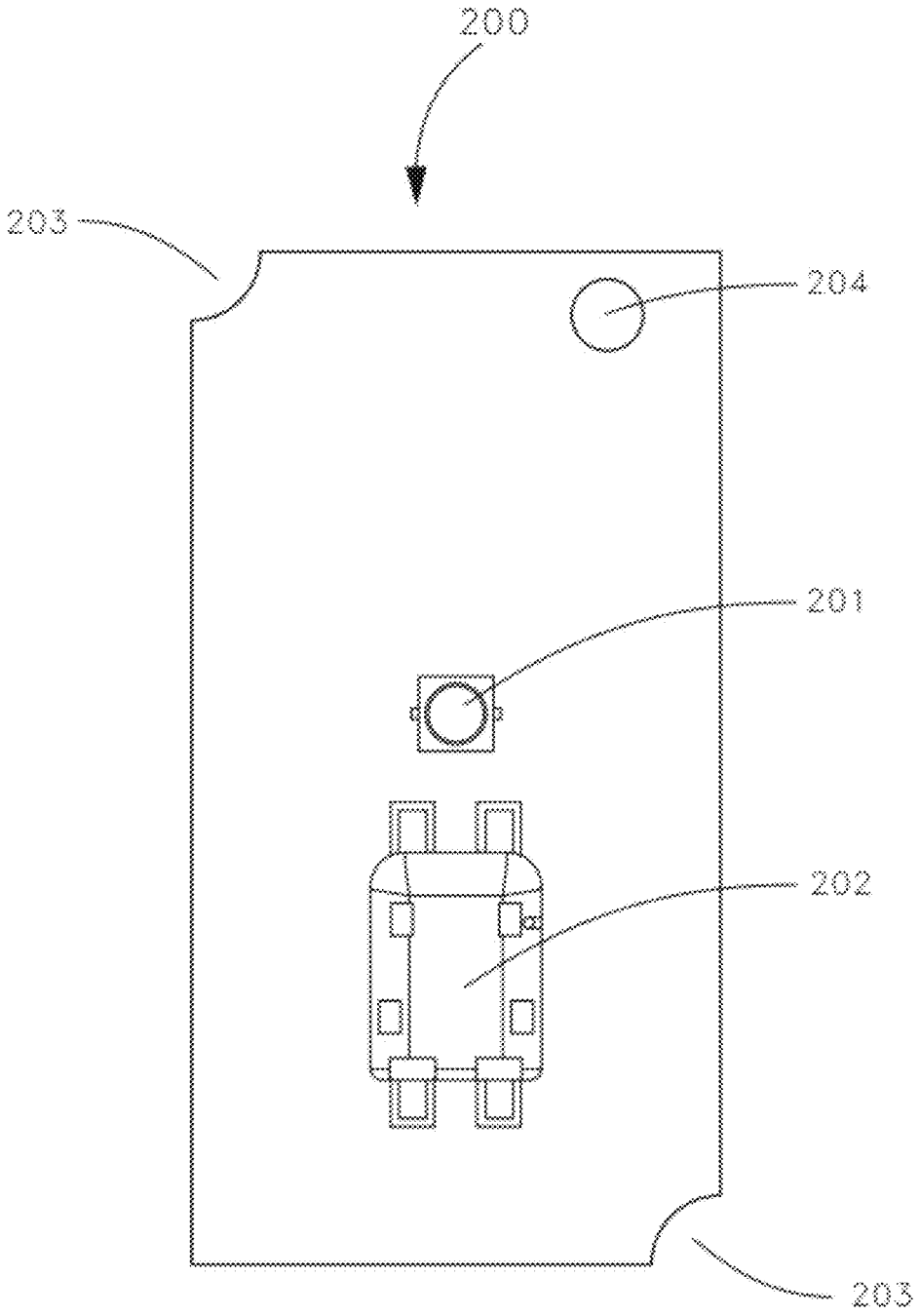
FIG. 2 illustrates an enlarged isolated front view of the LED board of FIGS. 1A-C.
Figure 3D:
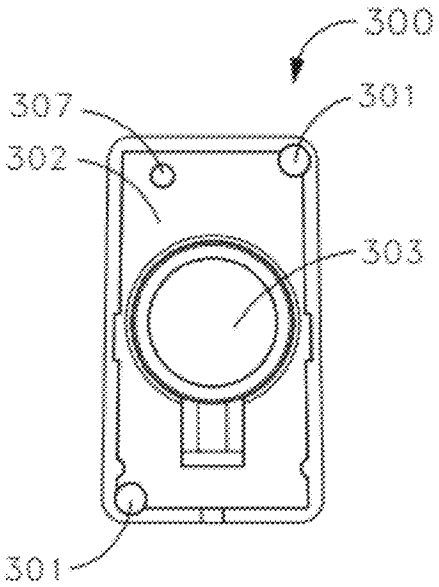
Figure 3C:
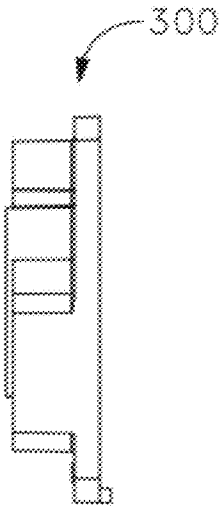
Figure 3B:
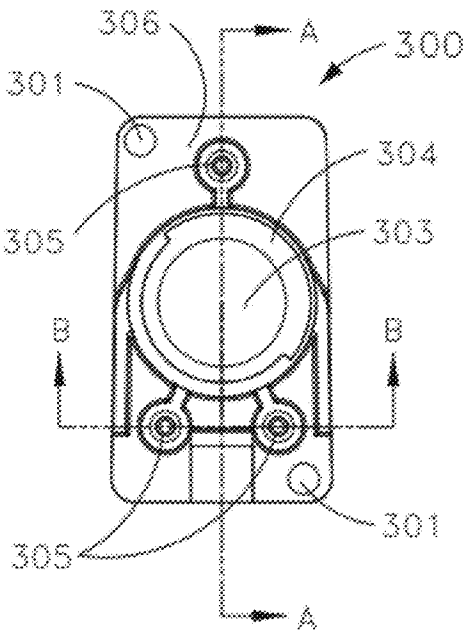
Figure 3E:
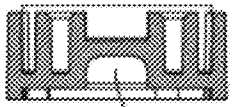
Figure 3A:
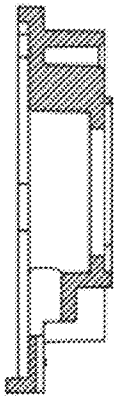

FIG. 2 illustrates circuit board 200 in greater detail. As illustrated, each LED module 10 comprises a single board 200 with a single LED 201 mounted thereon; in this example model XP-G or XM-L available from Cree, Durham, N.C., USA, though other types, models, and brands of light source are possible, and envisioned. Circuit board 200 further includes a push-button terminal block 202 (also referred to as a poke-in connector) to aid in the rapid replacement of an LED if it fails; in this example model 1-1954097-1 available from Tyco Electronics, Berwyn, Pa., USA, though other models and types of connectors are possible, and envisioned. Board 200 further includes cutouts 203 and hole 204 so to ensure board 200 is properly oriented within module 10, though this is not a limitation of the invention. If desired, board 200 could have multiple LEDs mounted thereon and connected in series; this would directly impact efficacy for a given power input, as well as the beam output pattern projected therefrom, and is discussed in provisional U.S. Application Ser. No. 61/539,166 incorporated herein by reference, and to which U.S. Pat. No. 8,866,406, now issued, claims priority.

FIGS. 3A-E illustrate multiple views of housing 300. Back surface 302 of housing 300 is adapted to receive circuit board 200 and secure board 200 in place via a bolt (or analogous devices) through holes 301, curved apertures 203 (see FIG. 2), and into threaded blind holes in pivot half 101 (see FIG. 6A); as one alternative, a nut and bolt combination (or analogous device) with through-holes could be used in lieu of threaded blind holes in half 101. Front surface 306 of housing 300 is adapted to receive lens 400 through aperture 303 and permit a limited rotation thereof via track 304, as well as receive visor 500 via thread cutting screws through apertures 501 (see FIG. 5A) and into holes 305. Housing 300 further includes a void 308 which acts as a wireway for the wiring associated with LED 201 and a post 307 which extends through hole 204 of board 200 so to ensure proper orientation of board 200.

As envisioned, housing 300 is designed as the anchor point for LED module 10. For example, if an LED fails, the bolts can be removed from holes 301, the wiring cut, the defective board removed, a new board 200 seated against surface 302, the wiring reconnected via poke-in connector 202, and the bolts through holes 301 re-secured; this can occur rapidly and without disturbing the precise alignment of pivot joint 100 or orientation of lens 400. Alternatively, if a lens needs to be replaced (e.g., to effect a different beam output pattern), visor 500 can be removed by removing thread cutting screws from now threaded holes 305, the old lens removed, a new lens 400 seated in aperture 303 of surface 306, and the visor re-secured via the thread cutting screws through aperture 501 and into threaded holes 305; this can occur rapidly and without disturbing LED 201 or the alignment of pivot joint 100.

FIGS. 4A-C illustrate multiple views of lens 400. With regards to said figures—which illustrate a typical narrow beam lens—lens 400 comprises a generally parabolic outer surface 401, an LED-adjacent face 402, and an emitting face 403. As is well known in the art, through total internal reflection (TIR), light emitted from LED 201 enters face 402, is collimated, and projects outwardly from emitting face 403. Lens 400 further comprises a tab 404 so to (i) ensure proper seating between visor 500 (see reference number 506 of FIG. 5B) and housing 300 (see reference number 304), and (ii) allow for easy rotation of lens 400 (e.g., for on-site adjustments).

The exact design of lens 400 will vary depending on the application, the aiming of a particular module 10, the number and layout of LEDs 201 on board 200, and the desired beam output, for example. In practice, every LED module 10 could have a different lens 400, which may require a variety of sizes and shapes of aperture 303 in housing 300 and aperture 505 in visor 500. As an example, for the board illustrated in FIG. 2, the lens illustrated in FIGS. 4A-C may be most appropriate. If multiple LEDs 201 are mounted to board 200—such as in aforementioned provisional U.S. Application Ser. No. 61/539,166—the shape (but not the function) of lens 400 can be expected to change, as well as the shape of apertures 303 and 505. This is best illustrated by comparing the lens of FIGS. 4A-C of the present application (which is sized for a single LED) with the lenses of FIG. 2 (sized for two LEDs in a linear or "elliptical" array) and FIG. 6 (sized for four LEDs in a two-by-two or "quad" array) of provisional U.S. Application Ser. No. 61/539,166. As another example, any of a number of commercially available lenses could be used. For example, any of the FCP series of lenses available from Fraen Corporation, Reading, Mass., USA could be used with a light shaping diffuser (e.g., any of those available from Luminit, Torrance, Calif., USA) to approximate a desired beam output pattern; in that example, however, visor 500 would likely need to be modified so to positionally affix a diffuser sheet.

FIGS. 5A-D illustrate multiple views of visor 500. As envisioned, visor 500 comprises a center aperture 505 through which light emitted from lens 400 is transmitted; said light is redirected off reflective surface 507 towards the target area. Visor 500 further comprises short and long edges (reference numbers 504 and 503, respectively) so to provide a distinct cutoff for light projecting to either side of module 10 (e.g., to prevent shadowing which can occur when light from one module strikes another module). To further ensure that light is precisely controlled, edges 503 and 504, as well as top portion 508, have blackened ribs 502; ideally, all surfaces of visor 500 other than reflective surface 507 are blackened (e.g., formed from black polycarbonate). As is well known in the art, poorly controlled light can not only limit the effectiveness of illuminating a target area in a desired fashion, but can also cause glare. While blackening visor 500 (except surface 507) is adequate glare control for some applications, it has been found that even blackened surfaces have somewhat high reflectivity at high incidence angles. Ribs 502 effectively trap and absorb any remaining light which could cause glare (also referred to as internal glow).

In practice, visor 500 could be molded or otherwise formed from black polycarbonate and then surface 507 metallized (e.g., using aluminum in finish MT-11000 available from Mold-Tech, Windsor, Ontario, Canada). Alternatively, visor 500 could be formed from a high reflectivity material (e.g., polished aluminum) and all surfaces other than 507 blackened; or visor 500 could be formed from a low cost polymer, blackened, and a strip of high reflectivity material inserted into visor 500 so to produce surface 507. If feasible, all components of module 10 other than reflective surface 507, lens 400, and LED 201 could be blackened. Surface 507 itself may be coated, peened, or otherwise formed so to provide specular, diffuse, spread, or any other nature of reflection as necessitated by the application.

Figure 5B:
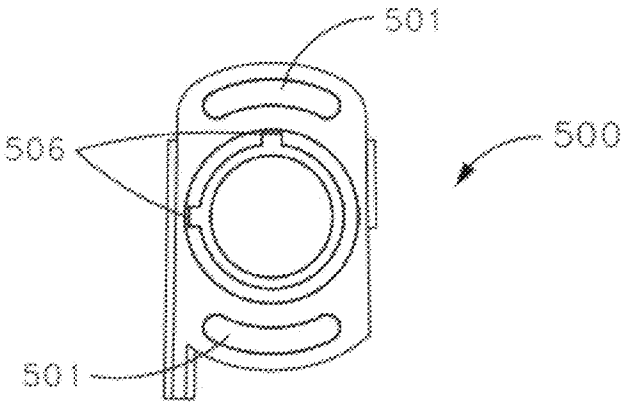
Figure 5D:
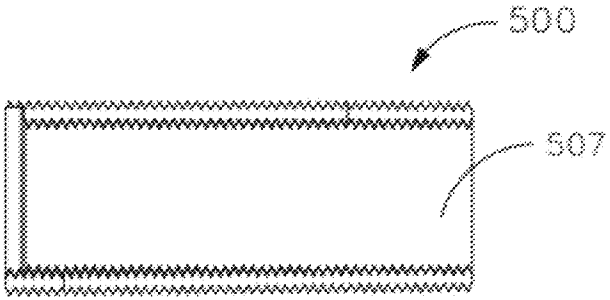
Figure 5A:
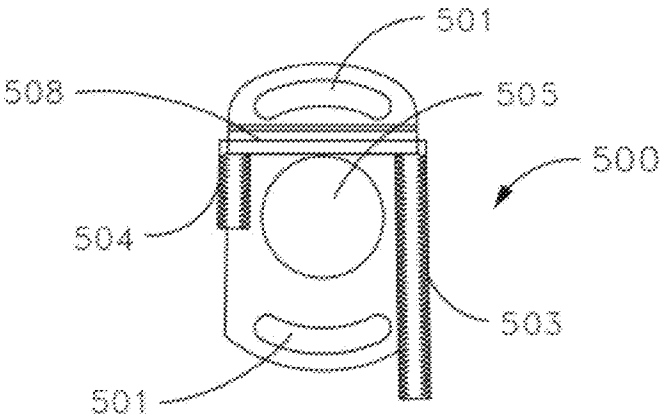
Figure 5C:
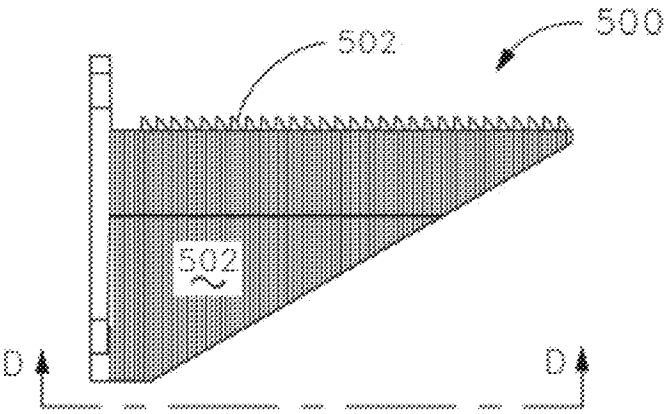

As with lens 400, the exact design of visor 500 can vary according to the application, desired beam output, and aiming of module 10. For example, a visor could have two long sides (see reference number 503) or two short sides (see reference number 504). Visor 500 could be longer or shorter than illustrated (the visor illustrated in FIG. 5A is on the order of three inches long), or could be rounded and without ribs. Some possible visor designs are illustrated in FIGS. 5E-I.

FIGS. 6A-D illustrate one possible design of pivot joint for use in module 10. Generally, pivot joint 100A comprises an LED-adjacent portion 101, a fixture-adjacent portion 102, and a stabilizing portion 103. In practice, pivot joint 100A is assembled and affixed to a module bar 50 (see also FIGS. 8A-G) via bolt 107, washers 104 and 105, and nut 106. By loosening bolt 107, LED module 10 may be pivoted about a first axis extending along the length of the rounded portion 115 of part 101 (see axis B in FIG. 6C), as well as pivoted about a second axis extending along the length of bolt 107 (see axis A in FIG. 6C); as envisioned, pivoting about axis B determines the vertical aiming angle and pivoting about axis A determines the horizontal aiming angle (see Table 1), though this could differ. The configuration of bolt 107, washers 104 and 105, and nut 106 ensures that only one hand is needed for tightening or loosening the assembly, freeing the other hand to adjust module 10; this is quite useful if modules 10 must be re-aimed on site. Another important feature of pivot joint 100A is bolt 107; as can be seen, flats are machined in the sides of bolt 107. This ensures that once bolt 107 is inserted in slot 51 of module 50 (see FIGS. 6C and 8D, G) and module 10 is moved to its correct position and aimed, that tightening of pivot joint 100A will not inadvertently rotate bolt 107 and change the precise alignment of module 10; similarly, webbing 114 on LED-adjacent portion 101 prevents lateral motion during tightening of pivot joint 100A which could also inadvertently affect the precise alignment of module 10. Yet another important feature of pivot joint 100A is the design of LED-adjacent portion 101; the rounded back portion 115 of part 101 ensures module 10 can be installed right-side-up or upside-down (this is discussed later) and the flat face of part 101 ensures a universal mounting surface for any number or type of light source (e.g., part 101 could receive a socket for a more traditional type of light source). Lastly, as envisioned the joint is formed from aluminum or some other thermally conductive material; this provides the benefit of a heat sink for LEDs 201 in modules 10.

Of course, other designs of pivot joint are possible, and envisioned. FIG. 6E, for example, illustrates a pivot joint which may be better suited if module bars 50 include a protrusion 53. Alternative pivot joint 100B still includes a fixture-adjacent portion 102 and an LED-adjacent portion 101; however, pivoting of module 10 is now achieved by adjustment of two bolts 107A and 107B (as opposed to bolt 107 of FIG. 6B). A still further alternative pivot joint 100C is illustrated in FIGS. 6F and G. In this alternative, pivoting of module 10 is also achieved via bolts 107A and 107B (similar to pivot joint 100B) but the joint itself is a more substantial heat sink; this could be beneficial if a multi-chip LED or multiple LEDs are used in each module 10. A still further alternative pivot joint 100D is illustrated in FIG. 6H. In this alternative, module 10 (when mounted on pivot joint half 101) may be moved along channel 55 of an alternative module bar 50 until a desired position is reached. Pivot half 101 may then be pivoted about a first axis (extending radially through portion 102) while at least partially contained within the notch in portion 102 and/or portion 102 may be rotated within channel 55 about a second axis (extending longitudinally through portion 102) until a desired aiming orientation is achieved. A stabilizing portion 103 may then be secured (e.g., via screw 107 in aperture 54) so to positionally affix module 10 in its desired orientation. Pivot joint 100D may be more desirable if modules are tightly packed in a fixture housing—as there is no need to reach around, below, or behind the pivot joint to secure the modules when aiming/re-aiming—or if modules must be mounted and aimed in situ instead of on a module bar which is then installed in a fixture housing.

Regardless of the precise design of pivot joint 100, it is beneficial if the joint (i) establishes a thermal dissipation path between module 10 and the fixture housing, (ii) permits a wide range of aiming angles of module 10, (iii) allows for rapid and easy assembly, and (iv) is compact in design so to allow a more efficient packing of modules 10 in a fixture.

B. LED Fixtures

As envisioned, some number of LED modules 10 are aimed and installed in a fixture, the fixture also aimed and installed (usually on a pole or other elevating structure); the exact number of modules and the aiming positions of each can vary according to the application, size of the fixture, composite beam output pattern, and the like. Discussed first are the mechanics of installing modules in a fixture housing, followed by a description of one possible way to design a composite beam output to suit an application and one possible way to aim a fixture and the modules therein so to achieve the composite beam output.

Each LED fixture is designed to contain one or more module bars 50 (see FIGS. 8A-G), one or more LED modules 10 affixed to each module bar 50 (see FIG. 9). As envisioned and is illustrated in FIG. 7, module bars could be installed in a reflector housing parallel to the ground (A) or parallel to the aiming axis of the reflector housing (B) so to ensure efficient packing of LED modules 10—though module bars could be installed in a reflector housing in any fashion. Generally speaking, a large-scale outdoor lighting fixture 1000 will include some form of elevating structure 80, some form of housing 70, and some number of module bars contained therein (irrespective of how they are aimed).

An exemplary design of module bar 50 is illustrated in FIGS. 8A-G. As can be seen, module bar 50 is curved so to match the interior of the exemplary design of reflector housing 60 (see FIGS. 10A-D) and includes holes 52 and apertures 51. As previously stated, in practice a module 10 may be affixed to module bar 50 via a bolt and nut combination (or analogous devices) through pivot joint 100A and aperture 51; said module could then be moved along the length of aperture 51 until a desired position is reached. Module bar 50 could be affixed to reflector housing 60 via bolts (or analogous devices) through holes 52 and into complementary threaded blind holes in housing 60. Of course, modules 10 could be affixed directly to housing 60, but this would require aiming of each LED module 10 in situ which could be time-consuming and difficult given housing 60 has been designed to contain a large number of efficiently packed modules.

An exemplary design of reflector housing 60 is illustrated in FIGS. 10A-D; as illustrated housing 60 is aimed 30° down from horizontal (i.e., a vertical aiming angle of −30°, though this is by way of example and not by way of limitation. Housing 60 comprises a wireway 61 which allows wiring from each board 200 to be run out each module housing 300 (via void 308) and out fixture housing 60 to a remotely located electronics enclosure 110 (see 110A and 110B in FIG. 15A); ideally, wiring is never exposed to the elements so to make the envisioned fixture robust and suitable for outdoor use. Housing 60 further comprises threaded blind holes 62 (or analogous features) for affixing housing 60 to a pole or other elevating structure 80; in this example, via an adjustable armature (see FIGS. 15A-F) similar to that described in U.S. patent application Ser. No. 12/910,443, incorporated herein by reference.

As stated, the precise design of each LED fixture will vary depending on many factors. However, regardless of the design of the fixture, the nature of the application, or other such factors, the exemplary approach to building the fixture to suit the needs of the application is the same; this approach is illustrated in FIG. 12. Exemplary approach 2000 is presently discussed in the context of a large-scale outdoor lighting system (particularly a bridge lighting system); however, it can be appreciated that method 2000 could be applied to other applications and that the following is but one way to practice aspects of the present invention.

Exemplary method 2000 begins by determining the requirements of the lighting application (see reference number 2001). For a bridge lighting application, some possible requirements may include the following, though are not limited to such.

1. Size and shape of the target area
   a. While the roadway spanning the bridge is of primary importance, the target area might also include areas adjacent to the roadway (e.g., pedestrian walkways) and/or a defined space above the roadway (e.g., structural features to be illuminated for aesthetic purposes).
2. Light levels
   a. The target area could have a specified minimum illumination (e.g., measured in horizontal and/or vertical footcandles), a specified lighting uniformity (e.g., a ratio of maximum to minimum illumination, a ratio of average to minimum luminance, etc.), or the like.
   b. The Philips Lighting Company Lighting Handbook, incorporated herein by reference, explains in great detail the nature of light and how light is characterized and measured; it is assumed that one of average skill in the art is familiar with these concepts and so the principals of basic light measurements are not discussed in this text.
3. Special requirements
   a. As stated previously, a particularly challenging bridge lighting application is one in which the roadway comprises multiple lanes of traffic, at least some of which travel in opposite directions. As such, the designer must consider not only lighting requirements specific to roadway lighting, but also must consider glare and other lighting conditions experienced by drivers.
   b. Chapter 13 of the aforementioned Philips Lighting Company Lighting Handbook, incorporated herein by reference, discusses the many particulars of roadway lighting.
   c. U.S. patent application Ser. No. 12/887,595 incorporated herein by reference (and now issued as U.S. Pat. No. 8,517,566) discusses the unique lighting needs of applications with opposing lanes of traffic, and means and methods for addressing these needs.

Knowing the requirements for the lighting application, the limiting factor(s) can be determined (see reference number 2002). As with many of the steps in methods 2000 and 3000 (see FIG. 13), there is rarely a definitive answer to step 2002; rather, there are more desirable answers depending on the ability of the designer, the nature of the application, budgeting, and the like. Assume, for illustrative purposes, the application requires lighting fixtures be affixed to existing structural features, and for aesthetic purposes, the customer has chosen a particular size and style of fixture housing. Obviously, any preference by the designer, customer, or governing body (e.g., IESNA) will impose some limitation on the project, but in this example, the primary limiting factors are mounting height of fixtures (because elevating structures are limited to pre-existing structural features), weight of the lighting system (so not to exceed loading capacity of the pre-existing structural features), and number of fixtures (because the size of a fixture housing is defined, there is limited space for mounting fixtures, and the overall weight of the lighting system is limited).

Knowing the requirements of the application, the designer can design a composite beam (see reference number 2003). To demonstrate aspects of the present invention according to steps 2003 and 2004, a comparison to prior art lighting is warranted. Traditional roadway luminaires are suspended above the roadway (e.g., by an L-shaped pole) and project light downwardly; because light is projected downwardly the luminaire must be mounted above a certain height so a typical driver cannot directly view the light source (i.e., experience glare). However, because the present application has lanes of traffic traveling in opposite directions and requires the use of existing structural features, a traditional roadway luminaire is not appropriate for the application. As can be appreciated, if traditional roadway fixtures were used, multiple poles would likely project out of the top of existing supports 80 in various directions over roadway 20 so to provide adequate lighting, and so would not be cost-effective or structurally sound according to the limits of step 2002. As such, to illustrate aspects of the present invention, it is more appropriate to make a comparison to a sports lighting-type fixture.

FIG. 11A illustrates a target area 20 (in this example, a roadway on a bridge) as it may appear illuminated by an array of traditional sports lighting fixtures 900. As can be seen from FIG. 11A, each array 900 is suspended from an existing structural feature on the bridge, and each array illuminates one direction of traffic flow (presumably satisfying all of the primary limiting factors of step 2002). As is well known in the art, traditional sports lighting fixtures are designed for a single, high powered light source (e.g., 1000 watt metal halide lamp), which is necessary so the full width of the lanes in each direction can be adequately illuminated. FIG. 11A illustrates two problems with using traditional sports lights in a relatively compact space from a shortened mounting height (e.g., tens of feet shorter than a traditional sports lighting application). Because traditional luminaires 900 use single, high powered light sources, areas of high intensity 2 (also referred to as hot spots) occur directly beneath support structures 80 and areas of spill light 1 illuminate areas other than roadway 20; both effects are undesirable and waste light. A large-scale outdoor lighting fixture 1000 utilizing aspects of the present invention solves these deficiencies, at least in part, because the light emitted from a plurality of precisely controlled light sources can be used to build a composite beam (see FIG. 11B) that meets the needs of the lighting application without wasting light. Looking back to step 2003 of method 2000, the composite beam in FIG. 11B can be developed according to the following, though is not limited to such.

1. Taking into account the necessary light level, uniformity, and/or other characteristics from step 2001, an initial composite beam pattern can be developed.
2. Taking into account the limiting factors from step 2002, mounting locations and number of fixtures can be determined and potential hot spots identified.
3. Having the information from steps 1 and 2, and knowing the principals of the Inverse Square Law, the composite beam can be broken down into narrow beams projected furthest away from the identified mounting positions and wide beams projects closest to the identified mounting positions.
   a. It is assumed one of average skill in the art of lighting design is familiar with the Inverse Square Law and so such mathematical equations/relationships are not discussed in this text.
   b. The terms "narrow beam" and "wide beam" are typically used to describe the shape/size of a beam pattern and are widely used in the art.
   c. Each individual beam pattern making up the composite beam pattern will likely need to be overlapped with adjacent beam patterns so to ensure uniformity, specified light level, or other considerations per step 2001 are met. An exemplary method is to overlap each beam pattern at 80% of its beam angle, where the beam angle defines the shape/size of the beam pattern at 50% maximum luminous intensity.

Once a suitable composite beam pattern is developed and said composite pattern comprises a number of suitable individual beam patterns, each of the individual beam patterns can be assigned to the fixtures (see step 2 above) according to step 2004 of method 2000. Again, there is no one correct determination for step 2004; rather, there are more desirable determinations depending on a variety of factors. As an example at the fixture level, for aesthetic reasons it may be beneficial to assign an equal number of individual beam patterns to each fixture (e.g., to ensure each fixture contains the same number of modules) or to assign individual beam patterns according to a specific layout (e.g., to ensure each fixture is aimed at the same angle, regardless of the aiming angles of the modules within each fixture). As an example at the module level, two individual beam patterns could be assigned to two modules each with a single LED contained therein, or two individual beam patterns could be assigned to a single module with multiple LEDs contained therein.

Ultimately, the complexity of step 2004 will be determined by the extent to which fixtures may be customized. Customization can be tailored by selection of aiming angles (of fixtures, modules, and module bars, if desired), light transmitting elements (e.g., size and design of lenses 400), light blocking elements (e.g., size and design of visor 500), and light redirecting elements (e.g., size and design of reflective surface 507), for example. It is of note, however, that depending on the limiting factors determined in step 2002, step 2004 could be completed prior to step 2003 (i.e., the fixture specifics decided upon first and the resulting composite beam built and reviewed for adherence to steps 2001 and 2002 afterward).

Once each individual beam pattern has been assigned to a fixture according to preference, restrictions, or otherwise, each fixture can be properly built and aimed according to method 3000 in FIG. 13. The first step is determining the fixture requirements (see reference number 3001); as previously stated, the overall LED lighting system is highly customizable so it is likely that each fixture in the system will have unique requirements. For the aforementioned bridge lighting application, some possible fixture requirements may include the following, though are not limited to such.

1. Aiming angle of fixture housing 60
2. Color and finish of the fixture
3. Special mounting considerations
4. Number, placement, and orientation of module bars 50 within housing 60
   a. The exact number of module bars 50 is directly related to the number of modules 10 a housing 60 must contain, which is directly related to how many individual beam patterns are associated with a particular fixture. If desired, the composite beam could be broken down into so many individual beam patterns that each module 10 is associated with an individual beam pattern, though given that the output pattern emitted from a single module 10 is quite small—particularly with respect to target area 20—this is somewhat impractical.
5. Placement and aiming of module 10 within housing 60
   a. The precise aiming of each module will depend on mounting height of fixture housing 60, aiming angle of housing 60, orientation of module bars 50 relative to the aiming angle of housing 60, and location of individual beam patterns relative to housing 60, for example.

Once a fixture's requirements are determined according to step 3001 of method 3000, the fixture housing itself may be aimed according to step 3002 (see also FIG. 10A); again, some methods of aiming a fixture housing to satisfy roadway lighting in which there are lanes of opposing traffic are discussed in aforementioned U.S. patent application Ser. No. 12/887,595.

Once fixture housing 60 is aimed according to step 3002 of method 3000, the first module bar/LED module assembly can be built according to step 3003 (see also FIG. 9). Each assigned module 10 will have a specific combination of optics (e.g., size and shape of visor 500 and type of lens 400) and be assigned a specific position on module bar 50; this is not unlike the approach taken to assemble customized reflectors discussed in U.S. Pat. No. 7,874,055 incorporated herein by reference.

Once LED modules 10 are installed on module bar 50, each may be aimed according to step 3004 of method 3000. As previously stated, it is likely impractical to assign an individual beam pattern to each LED module; it is more likely that the composite beam will be broken down into just enough individual beams that one or more rows of LED modules (see FIG. 9) is associated with an individual beam pattern (though this could differ). Knowing the position and aiming angle of fixture housing 60 relative to the composite beam pattern (i.e., relative to the target area), knowing the orientation and position of module bars 50 within housing 60, knowing the position of individual beams within the composite beam, and knowing which modules 10 are assigned to which individual beams, the precise aiming of each module 10 installed on bars 50 may be determined; Table 1 illustrates an example. As can be seen, each module is associated with a particular module bar, has a particular position on said module bar, has a particular vertical and horizontal aiming angle, has a particular number and model of LED(s), and has a particular lens type (e.g., "Ellip V" meaning an elliptical lens with the elongated axis along the vertical direction—see aforementioned provisional U.S. Application Ser. No. 61/539,166 for an example of an elliptical lens suitable for use with multiple LEDs installed on a single board). It is of note that for the sake of brevity additional options for each module (e.g., specific size, shape, and cutoff angle of visor) have been omitted and that Table 1 serves only to illustrate some of the factors involved in building the envisioned LED fixtures.

TABLE 1

Pole ID: A1
Fixture ID: 4
Fixture Aiming: Vertical −30°

| Module # | Module Bar # | Position on Bar (from center) | Vert Aiming | Horiz Aiming | LED Type | Lens Type |
|---|---|---|---|---|---|---|
| 1 | 1 | 40 | −25.2 | 5.8 | 1 XP-G | Wide |
| 2 | 1 | 0 | −16.8 | 5.0 | 1 XP-G | Wide |
| 3 | 1 | −40 | −25.4 | −5.0 | 1 XP-G | Wide |
| 4 | 2 | −140 | −16.1 | −2.8 | 1 XP-G | Narrow |
| 5 | 2 | −100 | −16.1 | −1.2 | 1 XP-G | Narrow |
| 6 | 2 | 20 | −16.0 | 0.1 | 1 XP-G | Narrow |
| 7 | 2 | 80 | −16.0 | 3.1 | 1 XP-G | Narrow |
| 8 | 2 | 140 | −16.3 | 4.4 | 1 XP-G | Narrow |
| 9 | 3 | 130 | −16.0 | −4.8 | 1 XP-G | Narrow |
| 10 | 3 | −80 | −16.1 | −3.2 | 1 XP-G | Narrow |
| 11 | 3 | 40 | −16.0 | −1.8 | 4 XP-G | Quad |

TABLE 1-continued

Pole ID: A1
Fixture ID: 4
Fixture Aiming: Vertical −30°

| Module # | Module Bar # | Position on Bar (from center) | Vert Aiming | Horiz Aiming | LED Type | Lens Type |
|---|---|---|---|---|---|---|
| 12 | 3 | 0 | −16.0 | −0.1 | 1 XP-G | Narrow |
| 13 | 3 | −40 | −15.9 | 1.0 | 4 XP-G | Quad |
| 14 | 3 | −10 | −16.0 | 3.8 | 1 XP-G | Narrow |
| 15 | 3 | 140 | −16.6 | 5.7 | 1 XP-G | Narrow |
| 16 | 4 | 130 | −15.9 | −3.9 | 2 XP-G | Ellip V |
| 17 | 4 | −80 | −15.9 | −2.1 | 2 XP-G | Ellip V |
| 18 | 4 | 10 | −15.9 | −1.0 | 2 XP-G | Ellip V |
| 19 | 4 | −10 | −15.9 | 0.3 | 2 XP-G | Ellip V |
| 20 | 4 | 80 | −16.2 | 3.8 | 2 XP-G | Ellip V |
| 21 | 4 | 140 | −16.3 | 5.1 | 2 XP-G | Ellip V |
| 22 | 5 | −50 | −15.8 | 1.3 | 3 XP-G | Ellip H |
| 23 | 5 | 0 | −15.8 | 1.9 | 3 XP-G | Ellip H |
| 24 | 5 | −10 | −16.0 | 2.1 | 4 XP-G | Quad |
| 25 | 5 | −70 | −15.8 | 2.4 | 4 XP-G | Ellip H |

As can be seen from the example in Table 1, each module 10 may need to be pivoted about one or both axes illustrated in FIG. 6C. Additionally, a module may need to have its visor and/or lens rotated to produce a desired effect. As previously stated, tab 404 of lens 400 seats in groove 506 of visor 500 which allows one to pivot both visor and lens together along track 304 of housing 300 a specified amount; in this example, on the order of 60° as defined by the arc of aperture 501 (the full rotation of which could require the removal of one or more bolts from holes 305), though the lens itself could be rotated 90° by seating in a separate groove 506 (which is useful for orienting elliptical lenses).

The mechanics of aiming a module 10 have already been discussed, but to do so in a rapid and repeatable manner it is beneficial if all modules associated with an individual beam pattern are aligned to a common reference—readily visible to an assembler—while affixed to module bar 50, but prior to module bar 50 being installed in fixture housing 60. U.S. patent application Ser. No. 12/534,335, incorporated herein by reference (and now issued as U.S. Pat. No. 8,300,219) discusses methods of aiming a plurality of objects to a common reference, though other methods are possible, and envisioned. In practice, each individual module could have a laser mounted thereon and the module pivoted until the beam projected from the mounted laser matched the position of an aiming point projected onto a wall or floor. This same approach could be applied to a module bar in that the laser could be mounted to the bar and aimed to a reference point and the aiming of each LED module mounted to said module bar assumed to be accurate once the bar is aimed. The aiming of the fixture housing could be assured using the same method. Of course, a laser need not be used; a sensor/receiver setup could be used. There are a variety of methods by which LED modules 10 may be precisely aimed and though it is perhaps the easiest to aim LED modules 10 prior to installation in fixture housing 60, it is not a departure from aspects of the present invention to aim modules in situ.

Once a module bar/LED module assembly is fully built and aimed, it may be installed in fixture housing 60 according to step 3005 of method 3000. Ideally, no additional aiming or modification to the assembly is required once affixed to the interior of housing 60. The process is repeated according to step 3006 for all modules in a given fixture, after which outer components (see FIG. 14B) are affixed according to step 3007 so to produce exemplary fixture 5000. Generally, step 3007 proceeds according to the following (see FIGS. 14A-D), though is not limited to such.

1. Gasket 45 is placed in a complementary groove in the opening of housing 60.
   a. Gasket 45 is necessary to ensure fixture 5000 is suitable for outdoor use, as well as to ensure the integrity of modules 10, which are not individually sealed.
   b. The unique design of fixture housing 60 and lens rim 40 (See FIG. 14D) shields gasket 45 from direct sunlight (e.g., if used outdoors) and light emitted from the light sources (e.g., LEDs 201) which could otherwise degrade gasket 45 prematurely.
   c. If desired, fixture 5000 could also include a vent (e.g., any model of protective vent available from W.L. Gore & Associates, Inc., Newark, Del.) to aid in maintaining an appropriate internal pressure within fixture 5000 (e.g., in the event of environmental changes). Such vents are well known in the art.
2. Outer lens 30 is positioned over the opening of housing 60.
   a. As envisioned, outer lens 30 includes an anti-reflective coating—as is commonly used in the art of optics—so to reduce internal reflection from 8% to approximately 2%.
3. Lens rim 40 is positioned over lens 30.
4. Screws 41 are threaded through tabs 43 of lens rim 40 into housing 60 so to compress outer lens 30 between lens rim 40 and housing 60.
5. Outer visor 90 is positioned in a complementary groove in lens rim 40.
   a. In the bridge lighting application discussed, each fixture 5000 is aimed with the flow of traffic and each module 10 contained therein is precisely aimed such that outer visor 90 is not designed to provide a distinct cutoff (as designed, visor 90 is angled downwardly approximately 20°, though this could differ); rather, visor 90 is designed to reduce internal glow (i.e., reduce perceived brightness of the source) and to reduce the effects of wind loading on fixture 5000. However, outer visor 90 could be designed so to provide a distinct cutoff, for purely aesthetic reasons, or otherwise.
6. Screws 42 are threaded into tabs 44 of lens rim 40 so to secure outer visor 90.

C. LED Lighting System

FIG. 15A-F illustrates portions of an exemplary LED lighting system designed to satisfy a bridge lighting application as previously described. According to aspects of the present invention, a plurality of exemplary fixtures 5000 (only one is illustrated for clarity) are affixed to an exemplary pole 81 (see FIG. 15C) via an armature (see FIGS. 15B, E-F) and aimed with the flow of traffic so to produce an exemplary composite beam output pattern 21 on target area 20 (only a portion of the light output pattern is illustrated for clarity). As envisioned, each fixture 5000 requires one or more drivers 111 to power a plurality of LEDs 201; in this example, each fixture requires three drivers rated at 150 watts each to operate approximately 80 XP-G Cree LEDs between 0.7 and 1.4 amps per LED (e.g., model TRC-150S140DT available from Thomas Research Products, Huntley, Ill., USA), though this could differ depending on the application. Enclosure 110B houses drivers 111 for fixtures 5000 whereas a similar enclosure 110A houses a controller 112 and equipment necessary to adhere to safety requirements 113; in this example, equipment 113 comprises a main disconnect switch, terminal blocks, fuse blocks, and surge suppressor, though this could differ depending on the application. If desired, enclosures 110A and 110B could be installed inside of pole 80 or under roadway 20, for example, for aesthetic purposes or otherwise.

The precise contents of enclosures 110A and 110B will vary depending on the needs of the application. For example, it is beneficial for controller 112 to be able to dim the lights and turn the lights on and off in response to some command. Said command could be facilitated on site (e.g., by the aforementioned main disconnect switch) or received from a remote location (e.g., received from a control center such as that described in U.S. Pat. No. 7,778,635 incorporated herein by reference). If the latter is desirable, then the means of networking multiple fixtures 5000 on multiple poles must be considered. A wired network could utilize powerline communications to connect each pole location and place the entire system in communication with a remotely located control center. Alternatively, if a wireless network (e.g., based on a ZigBee platform) is desirable, then controller 112 could include functionality to operate accordingly; an example of wireless control of an LED lighting system is discussed in U.S. patent application Ser. No. 12/604,572 incorporated herein by reference and now issued as U.S. Pat. No. 8,734,163. Though it is beneficial if the plurality of fixtures 5000 in the exemplary lighting system are connected via a wireless mesh network and controllers 112 therein capable of both communicating with a remotely located control center and executing method 4000 (see FIG. 16), at a minimum controllers 112 should be capable of controlling power to fixtures 5000 and keeping track of operating hours; the latter is necessary for the methodology of ensuring the longevity and light output of the system.

An exemplary design of armature is illustrated in FIGS. 15B, E-F, the functionality of which is similar to that described in the aforementioned U.S. patent application Ser. No. 12/910,443 and U.S. patent application Ser. No. 11/333,996 (now issued as U.S. Pat. No. 8,337,058), both of which are incorporated herein by reference. Of course, other designs of armatures are possible, and envisioned. Generally speaking, armature 600 comprises a knuckle plate 610, knuckle half 620, and knuckle half 630 (see FIG. 15E). The purpose of armature 600 is to affix fixture 5000 to pole 81 and in a manner that (i) permits pivoting of fixture 5000 relative to pole 81 and (ii) permits wiring from fixture 5000 to be run to the interior of pole 81 without exposing said wiring to the elements (e.g., to make the lighting system suitable for outdoor use).

As envisioned, each pole 81 includes one or more posts 83 (see FIG. 15C), each post 83 generally hollow and including a central aperture 84 to receive wiring from fixture 5000, as well as apertures 85 designed to receive ribbed neck bolts 86 (or analogous devices). In this example each post 83 includes four apertures 85 to accommodate any orientation of plate 610, even though in practice only two bolts 86 are used for any plate 610. In practice, bolts 86 extend through the crescent-shaped apertures in part 611 and engage nuts 618 (see also the aforementioned U.S. patent application Ser. No. 11/333,996). Pole 81 further comprises a handhole with associated cover 82 to allow access into the interior of pole 81—which is generally hollow—so to make the necessary connections to complete the circuit between drivers 111 and LEDs 201 (e.g., connect a wire harness). It should be noted that the exact design of pole 81 could differ depending on the needs of the application. For example, instead of posts 83 projecting out of the side of pole 81 (i.e., projecting out forward of traffic flow), pole 81 could include a more traditional crossarm at the top of pole 81. As another example, instead of using an existing structural feature, a custom pole could be designed and installed.

FIG. 15F illustrates armature 600 in greater detail. As can be seen, knuckle half 630 generally includes a plurality of threaded screws with associated washers 637 to affix part 631 to fixture 5000 (e.g., by threading into holes 62). In practice, a grommet 636 receives wiring from fixture 5000 and wiring is routed through the body of part 631 into the body of part 621 where it terminates at a connector 626. Connector 626 (which is secured to part 621 by screws 625) mates with connector 613 when parts 621 and 611 are brought into operative connection (i.e., when bolt and washers 628 engage internally threaded hex nuts 614). In this example, grommet 636 includes space for twelve wires (two wires per driver plus six additional wires for auxiliary devices such as photocells (discussed later)); it can be appreciated that grommet 636, as well as connectors 626 and 613, could be designed to accommodate any number of wires. In addition to keeping track of wires, grommet 636—along with member 635—serves to seal part 631 to fixture 5000. Similar members (see reference numbers 612, 615, 617, 622, and 623) ensure the portions of armature 600 seal against each other, as well as plate 610 sealing against post 83, without damaging wiring or exposing said wiring to the elements; said sealing members may be of a typical polymeric material (e.g., TEFLON®, VITON®) as found in many o-rings—or formed from some other material as may be appropriate for the application—and, if appropriate, may be painted over, potted, or otherwise secured in place (see, in particular, reference no. 615 which has little reason to be removable after armature 600 is installed).

Another important feature of armature 600 is that it provides a continuous grounding path so that, particularly in outdoor applications, a charge (e.g., from a lightning strike) can be dissipated into the earth; this is ensured by grounding springs 616, 624, and 634. Of course, this assumes fixture 5000, armature 600, and pole 81 are all electrically conductive, though this is not a limitation of the invention.

To facilitate aiming of fixture 5000 relative to pole 81, fixture 5000 may be pivoted about an axis extending along the length of bolt 633. As discussed in U.S. patent application Ser. No. 12/910,443, when a desired orientation is achieved, bolt 633 and associated washers and nut 627 may be tightened so to direct the load through friction rings 632. Likewise, fixture 5000 may be pivoted about a second axis extending along the axis of ribbed neck bolts 86. As discussed in U.S. patent application Ser. No. 11/333,996, when a desired orientation is achieved, bolts 86 and associated nuts 618 may be tightened.

D. Operating Long-Term

As previously stated, for large-scale outdoor lighting systems, such as that illustrated in FIGS. 15A-F and discussed herein, it is simply not practical to perform maintenance on the system in a traditional manner. There is a high cost to shutting down lanes of traffic so to replace failed LEDs yet there is also a high cost to overdesigning the system according to traditional practices (e.g., providing far more light than needed so that when some LEDs invariably fail, the system will still produce adequate light). Even traditional methods of overdesigning a lighting system cannot ensure the longevity of an LED lighting system because LEDs themselves have not been fully tested and their behavior over long periods of time is speculative at best. That being said, there is still a need for operating large-scale outdoor LED lighting systems long-term and the data currently available for LEDs is useful. An exemplary method 4000 which builds upon readily available data for LEDs to reasonably ensure the longevity of said LEDs for a defined operating time, and provide relatively constant light over said operating time, is illustrated in FIG. 16 and presently discussed.

A manufacturer will typically supply a variety of data for an LED; of primary interest is predicted end-of-life (EOL) data per the aforementioned LM-80 standard (also referred to as L70 data as EOL has been determined by IESNA to be the point when light output is 70% of initial), power consumption data (e.g., wattage per LED based on incoming current), and thermal resistance data. A first step (see reference number 4001) is to thermally characterize the fixture so to understand how the combination of a particular fixture and LED will affect the lifespan of the LED; in essence, to determine how effective a particular fixture design is as a heat sink for a particular LED. In practice, a software package (e.g., Qfin 4.0 available from Qfinsoft Technology, Inc., Rossland, British Columbia, Canada) is used to analyze the thermal characteristics of fixture 5000, the results are taken in combination with the power consumption data provided for the XP-G Cree LEDs used in fixture 5000, and a relationship is developed between forward current ($I_f$), LED power ($W_L$), fixture power ($W_f$), and LED case temperature ($T_a$). Knowing this relationship, and knowing the thermal resistance data for the LED, a formula relating LED junction temperature ($T_j$) to $I_f$ and a formula relating $T_a$ to $I_f$ can be developed.

The next step (see reference number 4002) is to photometrically characterize the light source so to understand how light output for a particular LED is impacted by current and temperature. In practice, the XP-G Cree LED is tested under a variety of conditions so to develop an array which correlates a combination of $T_j$ and $I_f$ to a luminous flux ($\Phi$); standard photometric testing procedures are well known in the art (see, for example, IESNA standard LM-79) and so are not further discussed in this text.

Having the information from steps 4001 and 4002 is necessary to aid in determining the limiting factor(s) per step 4003 of method 4000. Similar to step 2002 of method 2000, determining the limiting factor(s) requires some knowledge of the application. For example, knowing the lighting requirements of the application determines, at least in part, what model of LED is used and in what quantity. Knowing the model of LED, the quantity of LEDs, and any other application-specific power requirements (e.g., requirements to be UL listed) determines, at least in part, the model and quantity of LED driver. Finally, knowing the capacity of each LED driver and the capacity of each LED determines, at least in part, a maximum forward current ($I_{FM}$) for each LED. $I_{FM}$ is defined as the desired current of each XP-G Cree LED in fixture 5000 at the end of the predefined operating period (which could vary depending on the application). However, an important aspect of the present invention is one which is somewhat counterintuitive; the model and quantity of LED driver must also be selected such that each XP-G Cree LED in fixture 5000 could exceed $I_{FM}$, if necessary; this permits significant flexibility in correcting for adverse operating conditions, some of which have already been discussed.

Generally speaking, it is desirable to closely match the driver for the intended load in terms of wattage, current, and the like. If a driver and load is mismatched, the driver is less efficient; this concept is well known in the art. It is counterintuitive, then, to purposefully mismatch the driver and load in present invention; however, it allows method 4000 (and the present invention as a whole) the flexibility to reasonably ensure the predefined number of operating hours can be reached. In this manner, the LED system as a whole costs more than a traditional system would, but less than what it would cost to replace all the drivers near EOL if it becomes apparent the system will reach EOL prematurely. In practice, the driver selected is one that is (i) dimmable, (ii) capable of running the LEDs at $I_{FM}$, (iii) capable of running the LEDs above $I_{FM}$, and (iv) capable of running the LEDs well below $I_{FM}$ ($I_L$), where $I_L$ is no less than 50% of the current described in (iii) above (e.g., to limit driver inefficiency). It is beneficial if the selected driver is capable of linear dimming (i.e., dimming at 100% duty cycle) as it is known that driver efficiency suffers when dimming is effectuated by reducing the duty cycle, though this is not a limitation of the invention.

Knowing $I_L$ one can determine the corresponding light output ($\Phi_L$) based on the matrix developed in step 4002; again, this is specific to the make and model of LED. Using $\Phi_L$ as a lower light output threshold, an upper light level threshold ($\Phi_H$) can be determined taking into account a defined light depreciation before compensation is made. Ideally, light output is constant; there is little benefit to ensuring the longevity of an LED lighting system if the light output is permitted to degrade to the point that the light is inadequate for the application. That being said, it is impractical to maintain truly constant light; though, the human eye is not adapted to perceive small changes in light levels so a relatively constant light output is permissible. In practice, $\Phi_H$ is calculated using a 2% light depreciation, though this is not a limitation of the invention.

Once all the limiting factors are identified, the compensation method to ensure longevity and relatively constant light in an LED lighting system can be executed (see step 4004). Conceptually, the LED lighting system is operated such that each LED sees the same current and the system produces an overall initial light output. Over time, the light output will decrease. When light output has decreased a particular amount, compensation will be made by increasing current to the LEDs by a particular amount for a particular length of time. When the particular length of time is reached, another compensation of a particular amount of current will be made for another particular length of time, and so on until the cumulative operating time of the system reaches the predefined number of operating hours.

Referring back to method 4000, and using $\Phi_H$ and $I_{FM}$ as constraints, the formulas developed in step 4001 can be solved for $I_f$ and $T_j$. $I_f$ and $T_j$ can be substituted back into the $T_a$ equation developed in step 4001 and the $T_a$ equation plotted against the L70 data provided by the manufacturer for the specific make and model of LED (in this example, model XP-G available from Cree) using the ENERGY STAR exponential equation established by the U.S. Department of Energy/Environmental Protection Agency to fill in gaps in data, though other methods of extrapolation could be used. The plotted equation, in essence, produces a new L70 curve for the specific LED case temperature ($T_a$)—where the x-axis is $I_f$ and the y-axis is hours. At this point, using methods well known in the art, one can analyze the new L70 curve to determine the length of time until light output is at 98% (i.e., a 2% depreciation rate). Thus, the current provided to each XP-G LED in fixture 5000 is set at the calculated $I_f$ for the length of time determined from the new L70 curve. Once the defined length of time has passed, the process (beginning with using $\Phi_H$ and $I_{FM}$ as constraints) begins again. Step 4004 repeats until the sum of each time frame equals or exceeds the predefined number of operating hours (or some other desired condition occurs).

As designed, the compensation per step 4004 is made relative to the stage (i.e., light depreciates 2% relative to what the light output was at the beginning of the extrapolated timeframe); however, this is but one way to practice the invention. For example, method 4000 could be adapted so light depreciation is measured relative to the initial light output of the system. As another example, instead of a percentage, $\Phi_H$ could be developed based on a specific number of lumens.

As envisioned, method 4000 is adapted to—for a particular combination of fixture and light source—reasonably ensure the longevity of the light source while providing relatively constant light. It can be appreciated that different types of light sources (e.g., low-wattage metal halide lamps) and different configurations of fixtures could be used and not depart from aspects of the present invention. Further, method 4000 was developed so to reasonably ensure longevity and relatively constant light for particularly challenging lighting applications where it is not practical to perform periodic maintenance or maintain a physical presence on site; however, this is by way of example and not by way of limitation. For example, it is possible that method 4000 could be updated based on actual light or temperature measurements; these could be made by a photocell or thermocouple installed inside fixture 5000 and in communication with controller 112, or by personnel on site (e.g., with a light meter and a laptop or other device capable of imparting instructions to controller 112), or even by personnel on site making light measurements, communicating said measurements to the remotely located control center, and the control center communicating changes to controller 112.

V. OPTIONS AND ALTERNATIVES

The invention may take many forms and embodiments. The foregoing examples are but a few of those. To give some sense of some options and alternatives, a few examples are given below.

A variety of methods and apparatuses have been described herein, as well as a variety of alternatives. It is of note that none of these are intended to be limiting. For example, instead of LEDs, lower wattage traditional light sources (e.g., metal halide lamps) could be used. As another example, the lighting application may comprise a sports field instead of a bridge or roadway. As yet another example, bolts and threaded blind holes could be replaced with a clamping-type mechanism. Likewise, a number of connective devices described herein (e.g., bolts, screws, etc.) could be replaced with some other form of connection (e.g., welding, gluing).

As another example, the design of fixture 5000 could differ from that illustrated. Instead of module bars 50 bolted into a housing 60 with a stepped cross-section, a plate 50A could be seated in a substantially solid housing; an example of this is illustrated in FIGS. 18A and B. In this alternative the heat sink is more substantial, but the aiming angles of each module are predefined (thus limiting any on-site adjustability).

As another example, some number of modules 10 in fixture 5000 could be installed in opposite fashion to other modules (e.g., so that the top view in FIG. 6D would become the bottom view) so to provide uplighting; this concept is generally illustrated in FIG. 17. As can be seen, a large-scale outdoor lighting fixture 1000 is affixed to an elevating structure 80. The majority of modules in fixture 1000 are aimed so to directly illuminate target area 20 via beam B1; however, some number of modules are installed upside-down so to project light upwardly via beam B2; beam B2 will still have some cutoff due to the external visor of fixture 1000. The wide range of aiming angles of the modules as envisioned ensure the composite beam is suited to a wide range of applications; in this example, house 22 is not directly illuminated (which could be undesirable) but both target area 20 and the space above target area 20 are adequately illuminated.

What is claimed is:

1. A lighting system for projecting light so to produce a customized beam output pattern at, near, or on a target area, the customized beam output pattern comprising one or more individual beam patterns, and comprising:

a. a pole or other elevating structure;

b. a lighting fixture having an internal space and structure in said internal space for receiving one or more lighting modules, each lighting module comprising:

i. one or more LED light sources;

ii. a lens having a light emitting surface and a source adjacent surface;

iii. a housing having an aperture for receiving the lens such that the source adjacent surface of the lens encapsulates the one or more light sources, said housing having structure to permit pivoting of the lens once received in the aperture;

iv. a visor mountable to the housing and having;

v. an aperture for transmitting a portion of the light from the light emitting surface of the lens;

vi. a reflective surface for redirecting a portion of the light from the light emitting surface of the lens; and vii. a shape designed to block a portion of the light from the light emitting surface of the lens at predefined angles;

c. an adjustable armature having a first end affixed to the pole or other elevating structure, a second end affixed to the lighting fixture, and an adjustable portion connecting the first and second ends adapted to provide pivoting of the lighting fixture in two axes relative the pole or other elevating structure;

d. one or more power regulating components adapted to provide plural power levels to the one or more lighting modules;

e. the one or more lighting modules adapted to produce the one or more individual beam patterns via selection of one or more of:

i. quantity of or model of LED light source;

ii. design of visor;

iii. design of lens;

iv. shape, size, or nature of reflective surface; and v. diffuser;

f. a pivot joint having a first end affixed to the structure in the internal space of the lighting fixture, a second end affixed to the one or more lighting modules, an adjustable portion connecting the first and second ends adapted to provide pivoting of the one or more lighting modules affixed to the second end about a first pivot axis relative the lighting fixture; and a fastening device adapted to both positionally affix the adjustable portion at an adjusted position and provide pivoting of the one or more lighting modules affixed to the second end about a second pivot axis relative the lighting fixture;

g. wherein said structure in the internal space of the lighting fixture comprises one or more spaced apart bars adapted to create rows of lighting modules when they are received in the lighting fixture wherein said rows are stacked so to produce at least one row of lighting modules in a higher position than another row of lighting modules.

2. The lighting system of claim 1 wherein the power regulating components are adapted to provide power to the one or more lighting modules according to a predetermined profile for a predetermined length of time.

3. The lighting system of claim 2 wherein a relatively constant light output of the one or more lighting modules is maintained over the predetermined length of time.

4. The lighting system of claim 3 wherein the relatively constant light output comprises a light output that is perceivably constant by the unaided human eye.

5. The lighting system of claim 2 wherein the predetermined profile for providing power to the one or more lighting modules is based on (i) a thermal analysis of the fixture and (ii) a photometric analysis of the one or more light sources.

6. A method of ensuring a number of operating hours at a minimum light level in the lighting system of claim 1 comprising:

a. thermally characterizing portions of the lighting fixture and lighting module in direct thermal contact with the one or more LED light sources and acting as part of a thermal dissipation path for said one or more LED light sources;

b. photometrically characterizing;

c. calculating light loss or depreciation of the LED light sources based, at least in part, on the thermal and photometric characterizations;

d. calculating a maximum forward current for the LED light sources to achieve said minimum light level at the end of said operating hours based, at least in part, on the calculated light loss or depreciation of the LED light sources;

e. powering the lighting system at an initial power level by the power regulating components; and f. incrementally increasing power to the lighting system by increasing the forward current according to a predefined profile until the lighting system has been operated for the ensured number of operating hours.

7. The method of claim 6 wherein the incremental increases to power are designed to compensate for light loss so to maintain a minimum light output level.

8. The lighting system of claim 1 wherein an internal wireway is established via one or more internal cavities in the (i) fixture, (ii) adjustable armature, and (iii) pole or other elevating structure.

9. The lighting system of claim 1 wherein the customized beam output pattern comprises both task lighting and uplighting simultaneously by adjusting a said one or more lighting modules relative the lighting fixture.

10. The lighting system of claim 1 wherein the visor further comprises a plurality of topographical features on an exterior surface designed to absorb a portion of the light emitted from a lighting module in the higher row position.

* * * * *